US008271247B2

(12) United States Patent
Davidson

(10) Patent No.: US 8,271,247 B2
(45) Date of Patent: Sep. 18, 2012

(54) MODELING AND MANAGEMENT OF RESERVOIR SYSTEMS WITH MATERIAL BALANCE GROUPS

(75) Inventor: Jeffrey E. Davidson, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 860 days.

(21) Appl. No.: 12/441,038

(22) PCT Filed: Oct. 4, 2007

(86) PCT No.: PCT/US2007/021324

§ 371 (c)(1),
(2), (4) Date: Mar. 12, 2009

(87) PCT Pub. No.: WO2008/054610

PCT Pub. Date: May 8, 2008

(65) Prior Publication Data

US 2009/0306947 A1 Dec. 10, 2009

Related U.S. Application Data

(60) Provisional application No. 60/855,653, filed on Oct. 31, 2006.

(51) Int. Cl.
*G06G 7/48* (2006.01)
*G06G 7/50* (2006.01)
*G06G 7/57* (2006.01)

(52) U.S. Cl. ..... 703/10; 703/9

(58) Field of Classification Search ..... 703/10
See application file for complete search history.

(56) References Cited

U.S. PATENT DOCUMENTS

| | | | | |
|---|---|---|---|---|
| 6,101,447 | A | 8/2000 | Poe, Jr. | |
| 6,128,579 | A * | 10/2000 | McCormack et al. | 702/13 |
| 6,236,894 | B1 | 5/2001 | Stoisits et al. | |
| 6,980,940 | B1 | 12/2005 | Gurpinar et al. | |
| 7,054,752 | B2 | 5/2006 | Zabalza-Mezghani et al. | |
| 7,079,952 | B2 | 7/2006 | Thomas et al. | |
| 7,096,172 | B2 | 8/2006 | Colvin et al. | |
| 7,200,540 | B2 | 4/2007 | Colvin et al. | |
| 7,451,066 | B2 | 11/2008 | Edwards et al. | |
| 2002/0165671 | A1 * | 11/2002 | Middya | 702/12 |
| 2005/0267719 | A1 | 12/2005 | Foucault | |
| 2006/0085174 | A1 | 4/2006 | Hemanthkumar et al. | |

OTHER PUBLICATIONS

Bringedal, B.O. et al. (2006), "Online Water-Injection Optimization and Prevention of Reservoir Damage" *SPE 102831*, pp. 1-6.

(Continued)

*Primary Examiner* — Suzanne Lo
(74) *Attorney, Agent, or Firm* — ExxonMobil Upstream Research Co. Law Dept.

(57) ABSTRACT

Methods and systems for modeling a reservoir system are described. The method includes constructing a reservoir model of a reservoir system. The reservoir model includes a reservoir and a plurality of wells. Also, one or more material balance groups are constructed with each material balance group having a portion of at least one of the plurality of wells, a portion of the reservoir, and at least one well management algorithm to track material balance within the respective material balance group. Then, fluid flow through the reservoir model is simulated based on the material balance groups by a simulator and the results are reported.

43 Claims, 11 Drawing Sheets

OTHER PUBLICATIONS

Clark, R.A. et al. (2003), "Voidage Replacement Ratio Calculations in Retrograde Condensate to Volatile Oil Reservoirs Undergoing EOR Processes," *SPE 84359, SPE Annual Technical Conf. & Exh.*, pp. 1-9.
Esor, E. et al. (2004), "Use of Material Balance to Enhance 3D Reservoir Simulation: A Case Study," *SPE 90362*, pp. 1-6.
Fenter, D.J. (1984), "A Multi-Level Well Management Program for Modelling Offshore Fields," *SPE 12964, SPE of AIME Europe Petrol Conf.*, pp. 75-82.
Gerami, S. et al. (2006), "Material Balance and Boundary-Dominated Flow Models for Hydrate-Capped Gas Reservoirs," *SPE 102234*, 15 pgs.
Ghorayeb, K. et al. (2003), "A General Purpose Controller for Coupling Multiple Reservoir Simulations and Surface Facility Networks," *SPE 79702, SPE Reservoir Simulation Symposium*.
Lawal, A.S. et al. (2004), Material Balance Reservoir Model for $CO_2$ Sequestration in Depleted Gas Reservoirs, *SPE 90669*, pp. 1-4.
Remmert, S.M et al. (2007), Implementation of ROP Management Process in Qatar North Field, *SPE/IADC 105521-PP*.
Seborg, D.E. et al. (1989), "Process Dynamics and Control," Wiley, New York, p. 195-196.
Steckel, A.W. et al. (1981), "An Example Approach to Predictive Well Management in Reservoir Simulation" *SPE 7698*, pp. 245-252.
Starley, G.P. (1988), "A Material-Balance Method for Deriving Interblock Water/Oil Pseudofunctions for Coarse-Grid Reservoir Simulation," *SPE 15621*, pp. 977-984.
Wallace, D.J. et al. (1983), "A Reservoir Simulation Model with Platform Production/Injection Constraints for Development Planning of Volatile Oil Reservoirs," *SPE 12261*, pp. 285-291.
Wang, P. et al. (2004), "Gas Lift Optimization for Long-Term Reservoir Simulations," *SPE 90506, Annual SPE Tech Conf.*
Wijesinghe, A.M. et al. (1983), "A Comprehensive Well Management Program for Black Oil Reservoir Simulation," *SPE 12260, SPE AIME Reservoir Simulation Symposium*, pp. 267-284.
PCT/US07/21324 International Search Report and Written Opinion, dated Sep. 19, 2008.

* cited by examiner

MODELING AND MANAGEMENT OF RESERVOIR SYSTEMS WITH MATERIAL BALANCE GROUPS

CROSS REFERENCE TO RELATED APPLICATIONS

This application is the National Stage of International Application No. PCT/US2007/021324, filed 4 Oct. 2007, which claims the benefit of U.S. Provisional Application No. 60/855,653, filed 31 Oct. 2006.

FIELD OF THE INVENTION

The present invention describes a method for modeling and managing reservoir systems with material balance groups (MBGs). In particular, the present invention describes modeling reservoir systems in a reservoir simulator that uses MBGs to apply well management algorithms to the reservoir system model to effectively manage the operation of the reservoir system.

BACKGROUND

This section is intended to introduce various aspects of art, which may be associated with exemplary embodiments of the present techniques. This discussion is believed to provide information that facilitates a better understanding of particular aspects of the present techniques. Accordingly, it should be understood that this section should be read in this light, and not necessarily as admissions of prior art.

The production of hydrocarbons, such as oil and gas, has been performed for numerous years. To produce these hydrocarbons, one or more wells in a field are typically drilled into a subterranean location, which is generally referred to as a subsurface reservoir, formation or basin. The wellbores are formed to provide fluid flow paths from the reservoir to the surface through drilling operations. These wells may be operated as injectors and/or producers in various well management strategies to produce hydrocarbons from the reservoir. Accordingly, a reservoir system may include the reservoir and facility networks, which include wells and surface facilities (e.g. pipes, separators, pumps, etc), associated with the reservoir.

To model the operation of the reservoir system, reservoir simulators are utilized to numerically model the production, injection and subsurface flow of fluids in porous media of the reservoir and facility network numerical models. The fluid flow is often modeled with the discretization of partial differential equations solved by finite difference, finite element or other numerical methods. The discretization results in the reservoir being divided into numerous cells (or nodes) that represent portions of a reservoir and/or a facility network. A reservoir node is a sub-division of the reservoir with properties, pressure (P), rock volume ($V_{rock}$), pore volume ($V_{pore}$), temperature (T) and moles of components ($Z_i$), which is assumed to be uniform though out the node.

As part of the reservoir simulation, boundary conditions of the reservoir and facility network numerical models are set to manage the rates and/or pressures of the reservoir system model. These boundary conditions, which may change as the simulation progresses, vary based on the different types of reservoirs, different types of wells, well patterns, fluids properties, rock properties, and economics. The determination of boundary conditions, which is typically referred to as well management or well management strategies, is typically defined by reservoir engineers to manage the production of hydrocarbons from an actual or simulated hydrocarbon reservoir system.

Numerous well management strategies may be utilized to improve the recovery and/or economics of hydrocarbon production. For example, the well management strategy may utilize primary depletion, which is producing fluids using the reservoir's inherent energy, or injecting fluids (e.g. typically water or gases) to displace the hydrocarbons. Also, the well management strategy may be to maintain pressure within the reservoir. This strategy may be useful in gas condensate or retrograde reservoirs, where liquid hydrocarbons drop out of a gaseous phases as the pressure drops. Liquids fractions are typically more valuable and move with greater difficulty through porous media; therefore, maintaining the pressure above the dew point is economically beneficial. Another well management strategy may involve drilling new wells (e.g. producers, water injectors and/or gas injectors) to maintain pressure or manage the flow of fluids within the reservoir. Further, the well management strategy may utilize enhanced oil recovery processes, which involve steam injection, polymer injection, $CO_2$ injection, and the like.

Because of the size of reservoirs and distance between wells, a time delay is present for any changes in the boundary conditions or operation of the wells. Accordingly, well management attempts to predict what effect changes in the operation of the wells (e.g. modifying the boundary conditions at a given time, for example) has on the reservoir and other wells in future production. As a result, the reservoir engineer as part of the well management strategy has to determine where to add producing wells (e.g. producers), what the producing wells rates are at certain times, where to add injecting wells (e.g. injectors), what are the compositions of the injecting wells, and what injecting well rates are at certain times. These determinations are further limited by numerous constraints that should be considered when setting appropriate boundary conditions. Typical constraints are minimum/maximum (min/max) oil production rates, min/max gas production/injection rates, max water production/injection rates, processing capacities, pumping capacities, gas-to-oil ratio (GOR), water cut (e.g. water rate/(oil rate+water rate) in surface volume units), concentrations of individual components, and economic constraints. These constraints and others may exist at different levels in the facility network, such as on individual wells, platforms, fields, projects, etc. Moreover, the boundary conditions have to honor a material balance constraint. For example, if water is to be injected into the reservoir at a certain rate, then a sufficient supply of water has to be provided to comply with the water injection rate.

Typically, three phases of fluids are modeled in reservoir simulations. For instance, with hydrocarbons, the two hydrocarbon phases include a liquid hydrocarbon phase (e.g. primarily composed of heavier hydrocarbon components that tend to be in a liquid state), and a vapor hydrocarbon phase (e.g. primarily composed of lighter hydrocarbon components that tends to be a gaseous state). The third phase is an aqueous phase (e.g. primarily composed of water). The hydrocarbon phases are made up of numerous different types of molecules (e.g. components). Gases in the vapor phase tend to be lighter in molecular weight and are highly compressible with increases in pressure resulting in a large decrease in volume. Further, because the vapor phase has a lower density and viscosity, it flows more rapidly through the pore spaces in the rock compared to the liquid and aqueous phases. The liquid phase is less compressible, but often contains dissolved gaseous components. As pressure increases, the liquid phase often absorbs more dissolved gas, which increases the volume of the liquid phase as pressure increases because the transfer of molecules from the gas phase to the oil phase. While this phase behavior may be valid for many hydrocarbon reservoir systems, some hydrocarbon mixtures may respond in a different manner. For instance, with gas condensates, as the pressure drops, liquid components may condense from the vapor phase. Compared to the liquid and vapor phases, the aqueous phase is relatively incompressible. Nevertheless, the aqueous phase volume is also a function of pressure, temperature and composition. In reservoir simulators, the vapor-liquid-aqueous equilibrium is often modeled using three components (e.g. oil, gas, and water) in three phases (e.g. liquid, vapor and aqueous), which is referred to as a black oil model. Another approach is to use equations of state, and is referred to as a compositional model, can model numerous components. Regardless, in the reservoir simulations, the volume of a phase and the fluid flow are a function of pressure (P), temperature (T), and composition (Z).

Further, as mentioned above, a model of a reservoir system or hydrocarbon network may be descretized spatially into nodes and in time increments known as time steps. In the reservoir system model, wells are connected to reservoir nodes, pore volumes of any reservoir node can be filled with multiple phases, and fluids flow from high potential to low potential. Accordingly, flow between reservoir nodes and connected wells is driven by differences in potential (e.g. the difference of phase pressures and hydrostatic head). To inject fluids into the reservoir system model, injector pressures at the wells have to be greater than reservoir pressures at the reservoir nodes. Reservoir engineers may specify boundary conditions (e.g. a pressure or a rate of one of the phases) and the simulator operates based on the boundary conditions. Likewise, to produce fluids, the producer pressure at the well has to be less than the reservoir pressure at the reservoir nodes. Reservoir engineers may specify the boundary conditions (e.g. pressure of well nodes or the rates of one of the phases) with the simulator operating based on as the boundary conditions, but rates of the non-specified phases that flow along with the specified phase will not be known until the calculations of the time step are complete.

At every time step, every node can have a different set of conditions (P, T, Z). The different set of conditions in the reservoir simulators are generally expressed in volumetric units, such as barrels of oil or cubic feet of gas, with a common reference set of conditions (e.g. standard conditions, which are 60° F., 14.67 pounds per square inch atmospheric (psia)). With common reference conditions, the mass-balance equations may be solved in the volumetric units. Accordingly, while the production and injection rates are generally measured and reported in surface volumetric units at standard conditions, material balance equations may be applied to enforce mass conservation. It should be noted that at each time step, oil phase rates are specified as boundary conditions on producers at the beginning of the time step. Injection rates of water and gas are set based on water and gas production rates estimated at the beginning of the time step. Because these are only estimates, the difference between production rates at the end of time step and the specified injection rates leads to an error in the material balance.

There are various ways to determine rates for injectors. For instance, voidage replacement is the well management strategy of injecting an equivalent reservoir volume of injection fluids as that of the production fluids. It should be noted that voidage is the volume of all produced fluids at reservoir conditions (e.g. reservoir pressure ($P_{res}$), reservoir temperature ($T_{res}$), reservoir composition ($Z_{res,i}$)) and voidage replacement balances reservoir volumes, not reservoir mass. The voidage replacement is generally monitored by a voidage replacement ratio (VRR), which is defined as the volume of injected fluid ($V_{res,inj}$) over the volume of produced fluids ($V_{res,prod}$). A VRR less than 1.0 indicates that the reservoir volume production is greater than reservoir injection volume, which often results in a decrease in the pressure within the reservoir. Similarly, a VRR greater than 1.0 indicates that reservoir injection volume is greater than reservoir production volume, which often results in an increase in the reservoir pressure. Typically, reservoir engineers attempt to maintain the pressure within the reservoir as a specific pressure. This is called pressure maintenance. This strategy is often implemented by using a target VRR near one.

Typical well management approaches focus on responding to current well behavior rather than changing conditions in the reservoir system. For example, typically reservoir simulators use reservoir conditions at each well to compute the reservoir volumes for both producers and injectors. This approach introduces some error in reservoir volume calculations, which also affects VRR calculations and pressure maintenance calculations. Accordingly, typical methods of well management have problems with injector allocation-for voidage replacement or pressure maintenance, because they use different pressures at injectors and producers for computing reservoir volumes, unreliable and potentially unstable methods for setting injector rates and neglecting material balance errors that develop because of the discretization of time in the simulator.

With regard to the problems of injector allocation for voidage replacement or pressure maintenance, the problem is further complicated when injecting vapor phase by the fact that produced hydrocarbons are heavier than the injected vapor or gases. That is, as the injected vapor migrates from the injectors, the volume of the injected vapor changes because of pressure changes in the reservoir and variations in temperature and composition in the reservoir. This type of problem is addressed in Ludolph et al., which describes a method of accurately calculating the VRR, as a post processing step in a gas-injection reservoir simulation. See, e.g., Clark, Robert A. Jr. and Ludolph, Brian, "Voidage Replacement Ratio Calculations in Retrograde Condensate to Volatile Oil Reservoirs Undergoing EOR Processes," SPE 84359, SPE Annual Technical Conference and Exhibition, Denver, Colo., 5-8 Oct. 2003. The method divides the reservoir into major pressure compartments and gives each pressure compartment a target pressure($P_{t\ arg}$). Then, the reservoir simulation is run to completion, periodically writing overall composition and average pressure in each of the reservoir units. The method numerically mimics mercury injection into a single cell PVT to calculate the relative injection gas-oil ratio. Using the changes in pressure between the storing of results, an over-injection or under-injection of gas for that period is calculated and utilized to compute the VRR for that time period. However, this method does not appear to address how to set injection rates to maintain pressure or maintain a target VRR.

To address the problem with setting injector rates, the target VRR within a reservoir simulation may be adjusted during the time steps of the reservoir simulation, as described in Wallace et al. See Wallace, D. J. and Van Spronsen, E. "A Reservoir Simulation Model with Platform production/Injection constraints for development planning of volatile oil reservoirs." SPE 12261, Reservoir Simulation Symposium, San Francisco, Calif., Nov. 15-18, 1983. In this reference, a well management strategy is implemented where a material balance used on the gas phase to inject all produced gas minus the quantities required for sales and fuel. Water injection is used to either achieve the desired VRR or maintain a target pressure. For a target VRR, the water rate is calculated by reservoir volume (voidage) balance. For a target pressure, the water rate for a given time step is calculated by the equation (EqA):

$$Q_{water,res,inj}=Q_{water,rev,inj}^{0}-C\times Dp/Dt \quad \text{(EqA)}$$

where C is the total system compressibility, $Q_{water,res,inj}^{0}$ is the water injection rate from the previous time step in reservoir volumetric units, Dp is the difference in the average region pressure from the target pressure ($P_{res,avg}-P_{res,t\ arg}$) and Dt is the current time step size. As such, pressure maintenance and voidage replacement is accomplished by injecting water after production and gas injection are taken in to account.

However, this matching of the target pressure in this method is deficient because it does not appear to account for pressure variations across the reservoir, fluid behavior affects or time stepping errors. For example, the rate in this method is a function of time step size. As the time step size (Dt) gets small, the corrective term (C×Dp/Dt) can become the dominating factor in the equation (EqA). Rate changes that increase in magnitude as the time step size is reduced can lead to numerical instabilities in the simulation. Also, rapid changes in rates can lead to overshooting the target pressure. If the overshoots grow in size, this can again lead to instabilities in the simulation. Further, when the time step size increases, the corrective term has less influence on the rate and the return to the target pressure is slower than the return for smaller time steps. Despite this weakness, the reference describes controlling the pressure for an extremely simple example (e.g. a box model of 600 nodes) by using the relatively incompressible injection fluid (e.g. water) as the "swing" phase. Accordingly, with a more realistic model, which utilizes dynamic time step sizes, the algorithm is likely fail because the corrective term causes the model to be unstable.

Another problem in previous methods is that they appear to fail to honor the material balance of injecting fluids over time. At the beginning of a time step, production rates are set, typically for the oil phase. The amount of gas and water that is produced with the oil is calculated based on beginning-of-time-step-reservoir conditions. Over the course of the time step, the reservoir conditions change and the actual gas and water rates at the end of the time step are typically different than those estimated at the beginning of the time step. For some wells in a reservoir, the fraction of gas and water in the production stream increase over time, therefore the amount allocated for injection at the beginning of the time step is less than that actually produced. Over many time steps, this difference can accumulate to a large number. This leads to a simulation where the amount of gas and/or water injected is under predicted. As a result, this under injecting may lead to under estimating production rates.

Other well management algorithms define groups of wells, but are deficient because they do not couple reservoir behavior directly with well management strategy. For example, Humanthkumar et al. discloses a method for providing well management for parallel reservoir simulation. See U.S. Patent Pub. No. US2006/0085174. While this application does disclose grouping of wells, which may contain subgroupings of wells up to several layers, these groupings. do not incorporate reservoir behavior with well management strategy.

Accordingly, the need exists to model one or more wells and one or more geobodies in a reservoir system as a group in reservoir simulations. In particular, the modeling of a reservoir system in groups of one or more wells and geobodies may use similar algorithms to efficiently manage the reservoir system.

Other related material may be found in at least in H. M. Brown et al. "Predictive Well Management in Reservoir Simulation—A Case Study," SPE 7698, pp. 245-252, SPE of AIME Reservoir Simulation Symposium, Jan. 31-Feb. 2, 1979; D. J. Fender et al. "A Multi-Level Well Management Program for Modelling Offshore Fields," SPE 12964, pp. 75-82, SPE of AIME Europe Petrol Conference, London, England, Oct. 22-24, 1984; W. E. Culham et al. "A Comprehensive Well Management Program for Black Oil Reservoir Simulation," SPE 12260, pp. 267-284, SPE AIME Reservoir Simulation Symposium, San Francisco, Calif., Nov. 16-18, 1984; Segorg, Dale E. et al., "Process Dynamics and Control," Wiley, N.Y., p. 195 (1989); Ghoraye, K. et al. "A General Purpose Controller for Coupling Multiple Reservoir Simulations and Surface Facility Networks," SPE 79702, SPE Reservoir Simulation Symposium, Houston, Tex., Feb. 3-5, 2003; and M. Litvak et al. "Gas Lift Optimization for Long-Term Reservoir Simulations," SPE 90506, Annual SPE Tech Conference, Houston, Tex., Sep. 26-29, 2004. Also other related material may be found in U.S. Patent Pub. Nos. 2005/0267719; 2005/0015231; 2004/00153299; 2004/0153298; U.S. Pat. Nos. 7,054,752; 6,980,940; and 6,236,894.

SUMMARY OF INVENTION

In one embodiment, a method of modeling a reservoir system is described. The method comprising constructing a reservoir model of a reservoir system, wherein the reservoir model comprises a reservoir and a plurality of wells; constructing at least one material balance group, wherein the at least one material balance group comprises a portion of at least one of the plurality of wells, a portion of the reservoir, and at least one well management algorithm to track material balance within the at least one material balance group; simulating fluid flow through the reservoir model based on the at least one material balance group by a simulator; and reporting results of the simulation.

In another embodiment, a second method of modeling a reservoir system is described. The method comprises constructing a reservoir model of a reservoir system, wherein the reservoir model comprises a reservoir and at least one injector well and at least one producer well; calculating production rates for the at least one producer well; calculating maximum injection rates for the at least one injector well; allocating injection fluids to the at least one injector well up to minimum rate constraints; allocating injection fluids to the at least one injector well up to the target voidage replacement ratio; simulating fluid flow through the reservoir model based on the allocated injection rates; and reporting results of the simulation.

In yet another embodiment, a third method of modeling a reservoir system is described. The method comprises constructing a reservoir model of a reservoir system, wherein the reservoir model comprises a reservoir and at least one injector well and at least one producer well; associating a portion of the reservoir with a material balance group; associating a portion of one or more well with the material balance group; specifying at least one well management algorithm for the material balance group; using the material balance group in the simulation of the reservoir model; and reporting results of the simulation.

In another embodiment, a fourth method of modeling a reservoir system is described. The method comprises constructing a reservoir model of a reservoir system, wherein the reservoir model comprises a reservoir and a plurality of wells; constructing at least one material balance group, wherein the at least one material balance group comprises a portion of at least one of the plurality of wells, a portion of the reservoir, and at least one well management algorithm; simulating fluid flow through the reservoir model based on the at least one material balance group by a simulator; tracking material balance within the simulation with the at least one material balance group; and reporting results of the simulation.

In another embodiment, a method of producing hydrocarbons is described. The method comprises obtaining simulation results, wherein the simulation results are based on a reservoir model of a reservoir system, wherein the reservoir model comprises a reservoir and a plurality of wells; and at least one material balance group, wherein the at least one material balance group comprises a portion of at least one of the plurality of wells, a portion of the reservoir, and at least one well management algorithm to provide material balance tracking within the at least one material balance group; operating the reservoir system based on the results; and producing hydrocarbons from the reservoir system.

In other embodiments, various aspects of the present techniques may be included. For instance, the at least one material balance group may couple reservoir behavior to a well management strategy represented by the at least one well management algorithm and reporting the results may include provides the results in a logical organization based on the at least one material balance group. Further, the simulating fluid flow through the reservoir model may include determining boundary conditions for the reservoir model based at least partially on the at least one material balance group for a plurality of time steps; and solving fluid flow equations that represent the fluid flow through the reservoir model based on the boundary conditions for the plurality of time steps. The at least one well management algorithm may be a voidage replacement algorithm that specifies a common reference pressure for the at least one material balance group. Also, the at least one well management algorithm defines at least one constraint for the at least one material balance group, wherein the at least one constraint comprises one of maximum injection rate for injectors, maximum injection rate for the at least one material balance group, maximum delta pressure, maximum well pressure, minimum injection rates for one of the plurality of wells or material balance group, minimum voidage replacement ratio, maximum voidage replacement ratio, and any combination thereof.

Determining the boundary conditions may include various different embodiments. For example, determining the boundary conditions may include calculating a cumulative difference between specified injection rates at the beginning of one of the plurality of time steps and calculated production rates at the end of the one of the plurality of the time steps; and adding a portion of the cumulative difference to specified injection rates at the beginning of another of the plurality of time steps that follows the one of the plurality of time steps. Alternatively, determining the boundary conditions may include calculating a cumulative voidage replacement ratio that is a cumulative volume of injected fluids at reservoir conditions divided by a cumulative volume of produced fluids at reservoir conditions; calculating a volume injection rate ($Vol_{inj,res}$) in reservoir volumetric units for one of the plurality of time steps based on the following equation:

$$Vol_{inj,res}=(VRR_{target}*Vol_{prod,res,cum}-Vol_{inj,res,cum})/\text{relaxation_time}+VRR_{target}*Vol_{prod,res,estimated\ for\ timestep}$$

where $VRR_{target}$ is the target voidage replacement ratio, relaxation_time is the larger of a user specified parameter and a size of the one of the plurality of time steps, $Vol_{inj,res,cum}$ is a cumulative volume of injected fluids at reservoir condition, and $Vol_{prod,res,estimated\ for\ timestep}$ is an estimated production rate of injectable fluids for the one of the plurality of time steps. Also, determining the boundary conditions may include solving a pressure maintenance algorithm to maintain a target average pressure that accounts for time delays associated with changes in production or injection. Also, determining the boundary conditions may comprise calculating a target voidage replacement ratio through the use of a proportional integral derivative controller. The calculating the target voidage replacement ratio for one of the plurality of time steps may be dynamically calculated by the equation:

$$VRR_{target}=1.0+K_c*(E_p+1.0/\tau_I*\int E_p dt+\tau_d/\Delta t*(E_p-E_{p,old}))$$

where $K_c$, $\tau_I$, $\tau_d$ are constants used to tune the proportional integral derivative controller, $E_p$ is the error in the target pressure minus the average pressure ($P_{target}-P_{average}$), $\Delta t$ is the one of the plurality of time steps and $\int E_p dt$ is the integration of pressure errors over time. In this equation, $\int E_p dt$ may be calculated for the one of the plurality of time steps at the end of the previous time step by the equation:

$$\int E_p dt+=(P_{target}-P_{average,\ beginning\ of\ TS\ value})*\Delta t$$

where $P_{average,\ beginning\ of\ TS\ value}$ is the average pressure at the beginning of the time step.

Further, in other embodiments, the methods may include allocating flow rates to the plurality of wells within the reservoir model based at least partially on the at least one material balance group. The allocated flow rates may be further based on well data, well constraints and reservoir data and may include allocating injection rates to at least one of the plurality of wells, wherein the plurality of wells comprise at least one producer well and at least one injector well. The allocation of injection rates may include calculating production rates for the at least one producer well; calculating maximum injection rates for the at least one injector well; allocating injection fluids to the at least one injector well up to minimum rate constraints; allocating the injection fluids to the at least one injector well up to the target voidage replacement ratio; provide allocated injection rates to simulator for at least one of the plurality of time steps. The calculating production rates for the at least one producer well may comprise calculating estimates of reservoir volume production rates and surface volume production rates at the beginning of one of the plurality of time steps, wherein the reservoir volume production rates and surface volume production rates add user-specified external sources and subtract user-specified external sinks. The calculating the maximum injection rates for the at least one injector well may comprise calculating injection rates when well pressure is set to a minimum of a maximum well pressure and a minimum of connected reservoir block pressure and maximum delta pressure; comparing the calculated injection rates with user specified maximum injection rates; and selecting the lower of the calculated injection rates and the user specified maximum injection rates. The allocating injection fluids to the at least one injector well up to minimum rate constraints may comprise calculating reservoir volume requested to meet the at least one material balance group constraint of a minimum voidage replacement ratio; calculating maximum injection rates in surface units; and allocating the injection fluids to the at least one injector. The allocating the injection fluids to the at least one injector well up to the target voidage replacement ratio may include calculating reservoir volume requested to meet the at least one material balance group constraint of a target voidage replacement ratio; and allocating the injection fluids to the at least one injector.

In other embodiment, method of constructing the at least one material balance group may comprise constructing a plurality of material balance groups, wherein each of the plurality of material balance groups comprises a portion of at least one of the plurality of wells, a portion of the reservoir, and at least one well management algorithm to provide material balance tracking within the each of plurality of material balance groups. Also, in this method, one of the plurality of material balance groups may further comprise at least one material balance group of the plurality of material balance groups. In addition, each of the plurality of material balance groups may be associated in a hierarchical structure between the plurality of material balance groups.

Moreover, aspects of the embodiments may be implemented in a computer-readable storage medium containing executable instructions which, when executed by a processor, perform operations for simulating fluid flow in a reservoir model.

BRIEF DESCRIPTION OF THE DRAWINGS

The foregoing and other advantages of the present technique may become apparent upon reading the following detailed description and upon reference to the drawings in which.

DETAILED DESCRIPTION

Figure 1:
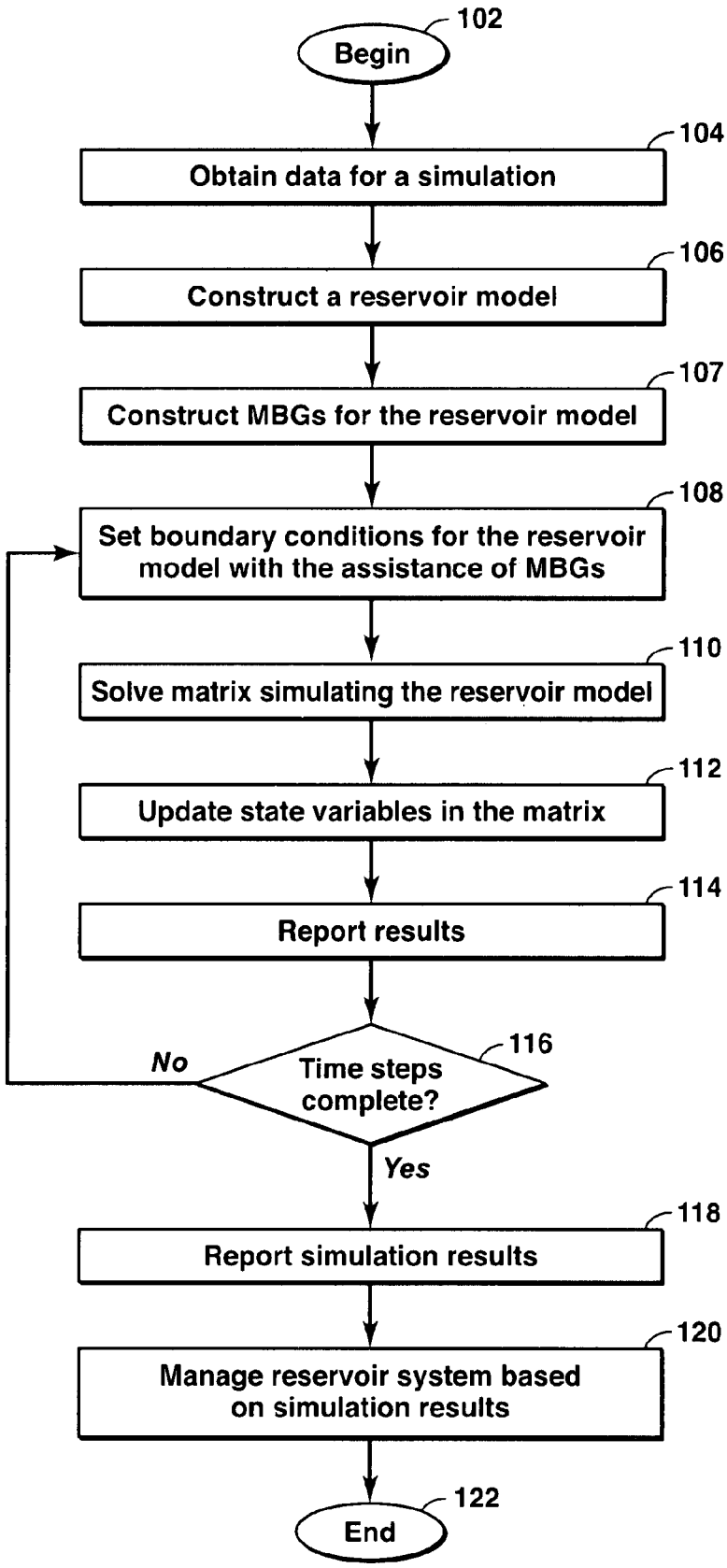
FIG. 1 is an exemplary flow chart of a process of modeling and operating a reservoir system in accordance with certain aspects of the present techniques.

In the following detailed description section, the specific embodiments of the present techniques are described in connection with preferred embodiments. However, to the extent that the following description is specific to a particular embodiment or a particular use of the present techniques, this is intended to be for exemplary purposes only and simply provides a concise description of the exemplary embodiments. Accordingly, the invention is not limited to the specific embodiments described below, but rather, it includes all alternatives, modifications, and equivalents falling within the true scope of the appended claims.

The present technique is directed to a method or system for modeling and managing a hydrocarbon reservoir. Under the present techniques, material balance groups (MBGs), which are software representations of logic and algorithms, are utilized to develop and to implement a well management strategy in a reservoir simulator for a reservoir system. MBGs may include a collection of producing and injecting wells, a portion of the reservoir, a collection of "children" MBGs, input data, result data, and numerical algorithms for computing results and implementing a well management strategy based on those results. The MBG is a new object in terms of well management, which is implemented as an object in an object-orientated computer programming language. That is, a MBG is a logical collection of wells with an associated reservoir region used to compute information, which may be used to present results and implement well management strategies. In particular, with MBGs, reservoir engineers may develop and implement well management strategies that are tightly coupled to reservoir conditions, not just to well performance. Because the pressure decline in the reservoir and flows across reservoir boundaries are indications of future well behavior, anticipatory well management strategies can be developed through the use of the MBGs. Accordingly, the MBGS of the present techniques provide a tight coupling of the reservoir blocks to the well management strategy to enhance the reservoir simulations.

Under the present techniques, the methods describe the use of process control theory to set well rates for the reservoir simulation, incorporation of material balance with built-in corrections to numerical errors for voidage replacement and pressure maintenance strategies, and development of well management strategies based on reservoir fluid flows across reservoir boundaries. The MBGs couple the wells with reservoir partitions to enhance material balance and volume balance calculations and use process control theory to determine appropriate injector rates for well management strategy, such as maintaining pressure within the reservoir system. This approach does not ignore the flow-based grouping, but is in addition to such a grouping. This tight coupling between the reservoir, producers and injectors, allows for enhanced reservoir management algorithms, such as maintaining pressure and honors the material balance for the MBGs. Material balance is accounting for all mass entering or leaving the system, such as a reservoir model, the facility model, or a portion of the reservoir or a subset of the facility model or any combination thereof.

Accordingly, under the present techniques, well management strategies include well management algorithms or logic that operate on individual wells, platforms (e.g. groups of wells), fields (e.g. groups of platforms), projects (e.g. groups of fields), and different combinations thereof. These algorithms are used to monitor well, field, platform and project performance and to provide analysis for well management based on current well performance and reservoir conditions. Such algorithms may include voidage replacement, fluid disposal, pressure maintenance, controlling flow across a boundary in the reservoir, well scheduling, determining well locations, etc. Thus, the MBGs allow reservoir engineers to develop well management algorithms based on reservoir responses, not just well measurements. The MBG approach also allows for more accurate reservoir volumetric calculations due to common reference conditions.

Turning now to the drawings, and referring initially to FIG. 1, an exemplary flow chart 100 of a process of modeling and operating a reservoir system in accordance with certain aspects of the present techniques is described. In this process, a portion of one or more reservoirs and surface facilities (e.g.

wells) are modeled in a modeling system to represent the flow of fluids within a reservoir system. In the simulation of this reservoir system model, MBGs are utilized to provide boundary conditions to the matrix representing the reservoir. The modeling system may include a modeling program of computer readable instructions or code that is executed by a computer system, which is discussed further below.

The flow chart begins at block 102. At block 104, data may be obtained for the simulation. The data may include material parameters (e.g. rock properties, fluid properties, initial state of the reservoir, proposed well locations and completions and the like). Then, a reservoir system model may be constructed as shown in block 106. The reservoir system model may include portions of a reservoir (e.g. geobodies) and well facilities (e.g. wells and well equipment). That is, the reservoir system model may include wells, pipes, separators, pumps, etc, which are known in the art. An example model of a reservoir system is described further below. At block 107, MBGs may be constructed for the model of the reservoir system. The MBGs are software collections of portions of wells and reservoir nodes, well management algorithms and associated data used to develop and manage a hydrocarbon reservoir system by implementing well management strategies in a reservoir simulation. The MBGs may include various well management algorithms, such as voidage replacement algorithms, pressure maintenance algorithms and injection allocation algorithms, for example.

Once constructed, boundary conditions are set with the assistance of the MBGs, as shown in block 108. The boundary conditions are the rates and/or pressures specified in the reservoir system model. As noted above, the boundary conditions may be based on different types of reservoirs, different types of wells, well patterns, fluids properties, rock properties, and economics. Boundary conditions change as the simulation progresses. At block 110, a matrix for the reservoir simulation may be solved. The solving of the matrix may include solving for changes in state variables over a time interval $\Delta t$ (e.g. time step). Then, state variables may be updated, as shown in block 112. At block 114, the results are reported. The MBGs may be used to group specific combinations of wells and portions of the reservoir for reporting of results. Reporting the results may include displaying the results to a display unit, storing the results in memory, and/or printing the results. Typical results are those values calculated by the MBG are discussed further below.

At block 116, a determination is made whether the time steps are complete. This determination may be made once a predetermined number of time steps have been performed or at a specific time. If the time steps are not complete, then the boundary conditions may again be set with the assistance of the MBGs, as discussed above in block 108. However, if the time steps are complete, the simulation results may be reported in block 118. Reporting the simulation results may include displaying the simulation results to a display unit, storing the simulation results in memory, and/or printing the simulation results. Then, the simulation results may be used, as shown in block 120. The use of the simulation results may include managing a hydrocarbon reservoir system represented by reservoir system model, drilling injectors and producers based on the simulation results,.operating injectors and producers based on the simulation results, and producing hydrocarbons from the hydrocarbon reservoir system represented by reservoir system model. Regardless, the process ends at block 122.

Beneficially, the present techniques may be utilized to model a hydrocarbon reservoir system in a manner to enhance the net present value of the reservoir and its production. The MBGs provide a mechanism to track the movement of fluids into and out of the reservoir region via the wells and across reservoir region boundaries; track reservoir properties in the associated reservoir region (e.g. average pressure, amount in place, etc.); and track volumetric movement of fluids at insitu conditions as well as other reference conditions. The MBGs may be utilized to organize the information for wells and a reservoir boundary, which may be presented or displayed to a user.

With this information from the MBG, well management strategies may be utilized to enhance management of the reservoir system. For instance, the MBGs may be used to develop well management practices that manipulate reservoir properties so as to enhance reservoir performance (e.g. net present value (NPV), oil recovery, etc.). Also, with the coupling of the reservoir region with the wells (e.g. in an MBG), well management algorithms may be developed and utilized to implement the well management practices. These well management algorithms may determine well or flow rates (e.g. boundary conditions) in the reservoir simulator. Further, these well management algorithms may utilize process control theory to account for the time lags in the modeled reservoir system that results from the size of the reservoir and the compressibility of the fluids. The well management algorithms in the MBGs may track and correct material balance errors that arise from numerical approximations used in the reservoir simulator. Accordingly, users may define objectives and constraints through the use of the well management algorithms associated with the MBGs. The well management algorithms may be used to implement well management strategies, such as voidage replacement, pressure maintenance, controlling flow across a boundary, injection allocation, and production allocation. The creation of the MBGs is discussed further in FIG. 2.

Figure 2:
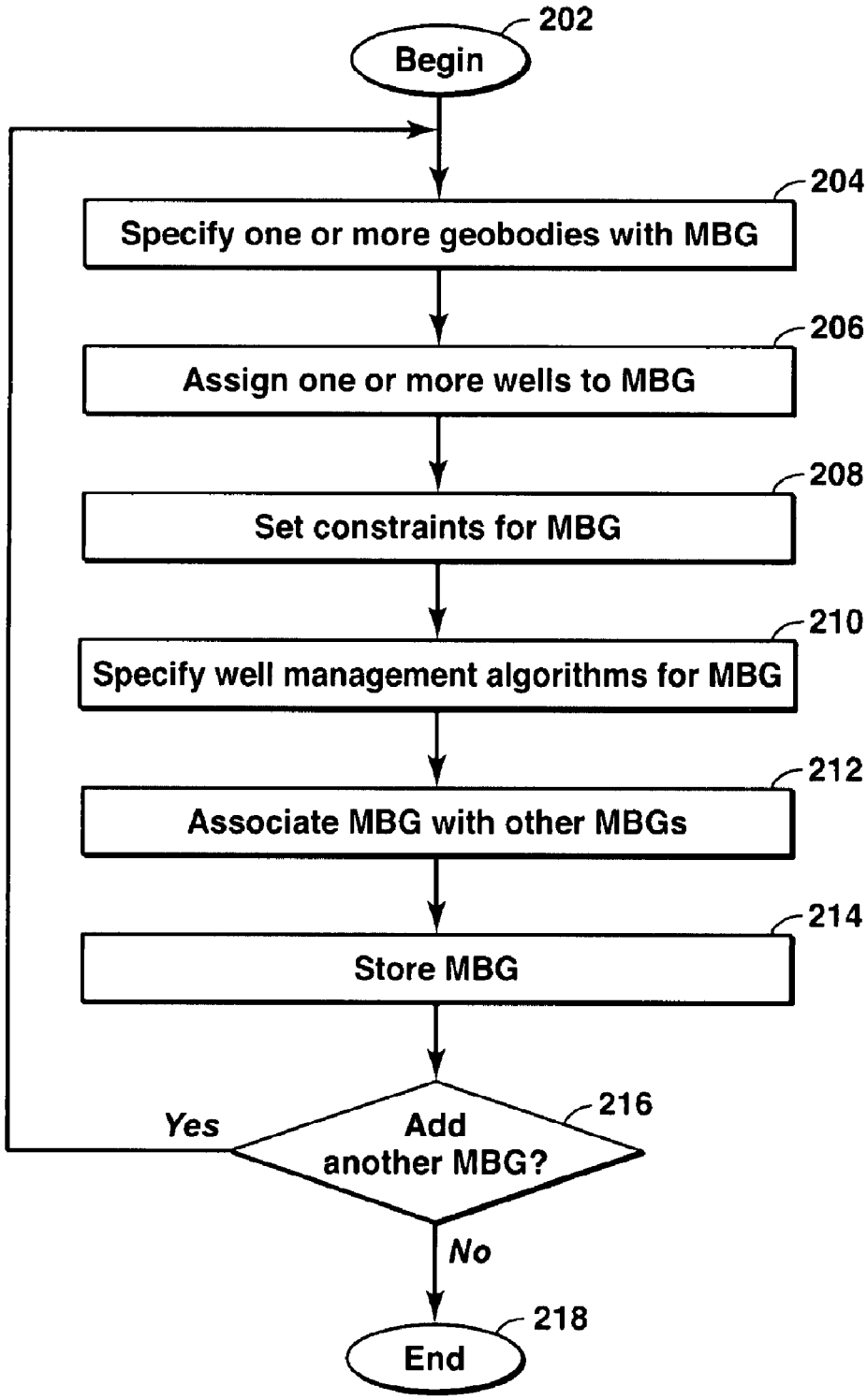
FIG. 2 is an exemplary flow chart of the formulation of MBGs for use in FIG. 1 in accordance with certain aspects of the present techniques.

FIG. 2 is an exemplary flow chart 200 of a process of constructing MBGs in accordance with certain aspects of the present techniques. In this process, MBG may be used for data collection management to measure and provide access to data with which decisions can be made to effectively develop a well management strategy. Each MBG may be used to calculate properties associated with the portion of the reservoir and the wells assigned to that MBG. For reservoir properties, MBGs may compute minimum, maximum and/or average (e.g. min/max/avg) of pressure, temperatures or saturation. Further, MBGs may be used to calculate volumes in place, moles in place, pore volume, saturations, percent recovery, VRR, cumulative VRR, etc. MBGs are also useful in computing the net flow of fluids into the associated reservoir region from different portions of the reservoir. Also, because MBGs may contain an arbitrary grouping of wells (e.g. producers and injectors), the group of wells in the MBG does not have to depend on the flow path (e.g. producers and injectors are not typically in the same flow path). For well related data, MBGs be used to calculate component rates, phase rates, cumulative rates, production rates, injection rates, rates across the boundaries reservoir node boundaries, VRR, cumulative VRR, etc.

The flow chart begins at block 202. At block 204, one or more geobodies are associated with the MBG. A geobody may be an arbitrary collection of reservoir cells, an entire reservoir, span multiple reservoirs or just a small region around a single well. The geobodies may also include fault blocks, a particular rock layer, reservoir connected to a pattern of wells, or the drainage area for a well or set of wells. Algorithms may be developed to calculate a geobody based on the connectivity in the reservoir. Then, one or more wells may be assigned to a MBG, as shown in block 206. The wells may be assigned to the MBG by a reservoir engineer directly or through an automated process. In some situations, a well may be specified that connects to portions of the reservoir, which spans multiple MBGs, may specify fractions of flow from a particular well to be counted in an MBG, or may specify those fractions, which are calculated dynamically by the MBG based on the flow from or into the geobody.

At block 208, rates may be specified for an MBG. The rates may be specified by a reservoir engineer from external sources (e.g. injectors) or sinks (e.g. producers). The sources may include fields or pipelines, while the sinks may include fuel, sales, pipelines, tanker terminals, flares etc. The MBGs handle the bookkeeping so that what is being produced and what is available for injection are known. Then, well management algorithms may be specified for the MBG, as shown in block 210. The well management algorithms may include different operations, such as objectives, strategies, constraints and actions, which may be specified in an MBG to manage the wells and the associated reservoir geobody. These well management algorithms include voidage replacement, pressure maintenance, coning/cusping control, well scheduling, well placement, which are discussed below. As an example, a well management strategy may be to produce 5000 barrels (bbls) of oil per day, while a well management strategy may be to inject all produced gas and to maintain reservoir pressure by injecting sufficient water. The constraints may include limiting the maximum water rate for the well group or for individual wells. Along with the constraints, actions may be specified to modify the operation if a constraint becomes active or violated. For example, if water production rate exceeds the current maximum possible water injection rate, an action to restrict overall production such that the water production rate does not exceed the injection capacity may be selected. Another possible action for this constraint may be to drill a new water injector. The knowledge (e.g. data and user-specified constraints) stored in and accessible to the MBG enables the MBG to calculate when the next water injector should be drilled and where it should be drilled.

At block 212, MBGs may be associated with a collection of MBGs, known as child MBGs. The parent MBGs may be used to monitor the material and volume balances on the set of children MBGs. The parent MBGs may also be used to allocate well rates across the children MBGs. As an example, a child MBG may be used to represent a platform, while a parent MBG may be used to represent a non-flow grouping, such as a field or a reservoir block. Then, the MBG may be stored, as shown in block 214. The storage of the MBG may include saving the MBG into a file, or memory, which may be the memory of a modeling system. At block 216, a determination based on the engineering judgment of the reservoir engineer whether to create an additional MBG is made. If an additional MBG is to be created, then one or more geobodies may be associated with it at block 204. However, if no additional MBGs are to be created, the process ends at block 218.

Beneficially, the present techniques may be utilized to organize and consolidate well management strategies into a single object as compared to specifying input data and algorithms across numerous facility objects (e.g. well nodes or reservoir nodes). Accordingly, the different well management algorithms are discussed further below.

Voidage Replacement Algorithms

The coupling of a reservoir region or geobody with the associated wells in an MBG framework enhances voidage replacement calculations over current algorithms. In particular, voidage replacement algorithms may be utilized to enhance calculations for a reservoir simulation. For example, one enhancement of the present techniques is specifying a common reference pressure for the MBGs, which is used to calculate reservoir volumes. The common reference pressure may be a user-specified pressure, or the average pressure for the associated reservoir region. The use of the common reference pressure eliminates the error introduced by other methods that compute voidage production rates at a lower pressure than reservoir volume injection rates. Thus, using the reservoir average pressure as the common reference pressure accounts for variations in pressure over time.

As another enhancement, MBGs may be used to correct surface volume balance errors. In this enhancement, MBGs may track the cumulative difference between specified injection rates (e.g. at the beginning of the time step) and the calculated production rates (e.g. at the end of the time step). The discrepancy or error, which is referred to as surface volume balance error, may be eliminated or reduced by adding it into the injection rates over the future time steps. The surface volume balance error may be adjusted based on a user specified time. For example, if the user has specified to re-inject a phase, the surface volume balance error is accumulated at every time step for that phase, as shown in equation (Eq1):

$$\text{SurfaceVolProdInjError[phase]}+=\Delta t*\text{SurfaceVolProductionNetRate[phase]} \quad \text{(Eq1)}$$

where SurfaceVolProdInjError[phase] is the cumulative difference between produced injectable fluids as calculated at the end of a time step and the injection rates determined based on estimates at beginning of time step conditions, Δt is time step size, and SurfaceVolProductionNetRate[phase] is the volume of difference between injection rates as calculated at the end of a time step and the injection rates determined based on estimates at beginning of the time step conditions.

If, at a given time step, the injectors for a given phase are injecting at their maximum capacity, this error accumulation is set to zero. Thus, the production legitimately exceeds the injection capacity and therefore it is not an "error." When determining how much injection fluid is available for injection at a given time step, the estimated production rates of that fluid are added to the SurfaceVolProdInjError. A time dampening factor is used as shown in the following equation (Eq2) to avoid trying to add re-inject all of the error at once. These reduced numerical instabilities that arise when a large time step with significant error is followed by a small time step.

$$\text{SurfaceVolAvailableToInject[phase]}=\text{SurfaceVolProductionRate[phase]}+\text{SurfaceVolProdInjError[phase]}/\text{relaxation_time} \quad \text{(Eq1)}$$

where SurfaceVolAvailableToInject[phase] is the total amount of an injectable phase available to inject at this time step, SurfaceVolProductionRate[phase] is the estimated amount produced water and gas available to inject at the current time step based on estimated production rates, and the relaxation time relaxation_time is used to dampen out large changes in rate and is the larger of a user specified parameter and the current time step size.

As yet another enhancement, MBGs may be associated with the cumulative VRR as a goal rather than the instantaneous VRR for a given time step to correct reservoir volume balance errors. The cumulative VRR is defined in equation (Eq3) as:

$$VRR_{cum}=Vol_{inj,res,cum}/Vol_{prod,res,cum} \quad \text{(Eq2)}$$

where $VRR_{cum}$ is the cumulative VRR, $Vol_{inj,res,cum}$ is cumulative volume of injected fluids at reservoir conditions, and $Vol_{prod,res,cum}$ is cumulative volume of produced fluids at reservoir conditions. At any given time step, the requested reservoir volume to inject is defined in the equation (Eq4) as:

$$Vol_{inj,res}=(VRR_{target}*Vol_{prod,res,cum}-Vol_{inj,res,cum})/\text{relaxation_time}+VRR_{target}*Vol_{prod,res,estimated\ for\ timestep} \quad \text{(Eq3)}$$

where $VRR_{target}$ is the target VRR, relaxation_time is as described in equation (Eq2), $Vol_{inj,res}$ is injection rate in reservoir volumetric units, and $Vol_{prod,res,estimated\ for\ timestep}$ is the estimated production rate of injectable fluids for the given timestep.

This formulation addresses the errors in voidage replacement that accumulate due to time discretization. This is similar to the time discretization error that arises in the surface volume balance, but the error referred to in this paragraph is the reservoir volume balance. In the situation where production starts before injection, this formulation allows for the voidage replacement strategy to approach the target. Traditional well management algorithms use equation (Eq5) to determine the injection volume. The equation (Eq5) does not have the ability to adjust injection rates to correct for time discretization error.

$$Vol_{inj,res}=VRR_{target}*Vol_{prod,res,estimated\ for\ timestep} \quad \text{(Eq4)}$$

Accordingly, MBGs enhance the calculations by tracking and storing the cumulative and instantaneous injection, production, and net volumes for the set of wells and the associated reservoir geobodies and use this information to correct material balance errors that arise from traditional well management algorithms.

Figure 3A:
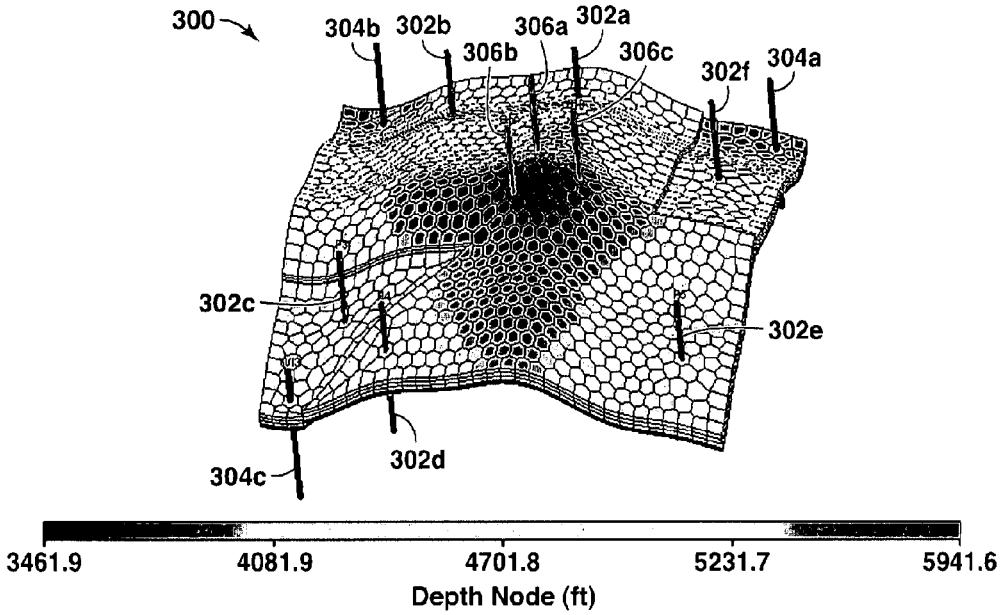
FIGS. 3A-3E are exemplary diagrams of reservoir system model and responses of voidage replacement algorithms for MBGs in accordance with some aspects of the present techniques.

As an example, FIGS. 3A-3E are exemplary diagrams associated with voidage replacement methods used for a reservoir system model. In FIG. 3A, an exemplary reservoir system model 300 has six producers 302*a*-302*f*, three water injectors 304*a*-304*c* and three gas injectors 306*a*-306*c*. The well management strategy for this reservoir system model 300 may be to produce at the highest oil rate possible at every time step and to inject all gas and water that is produced.

Figure 3B:
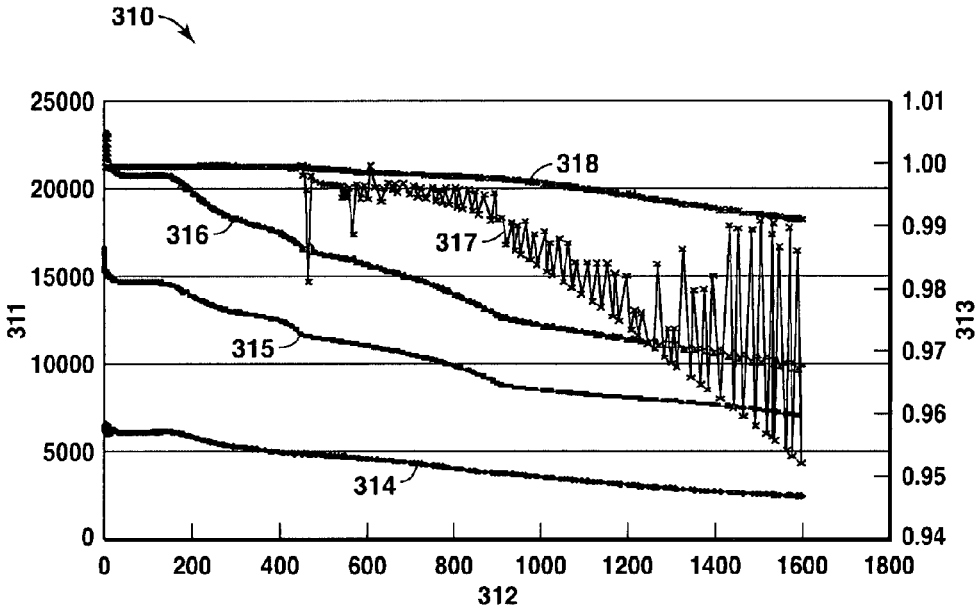
Figure 3C:
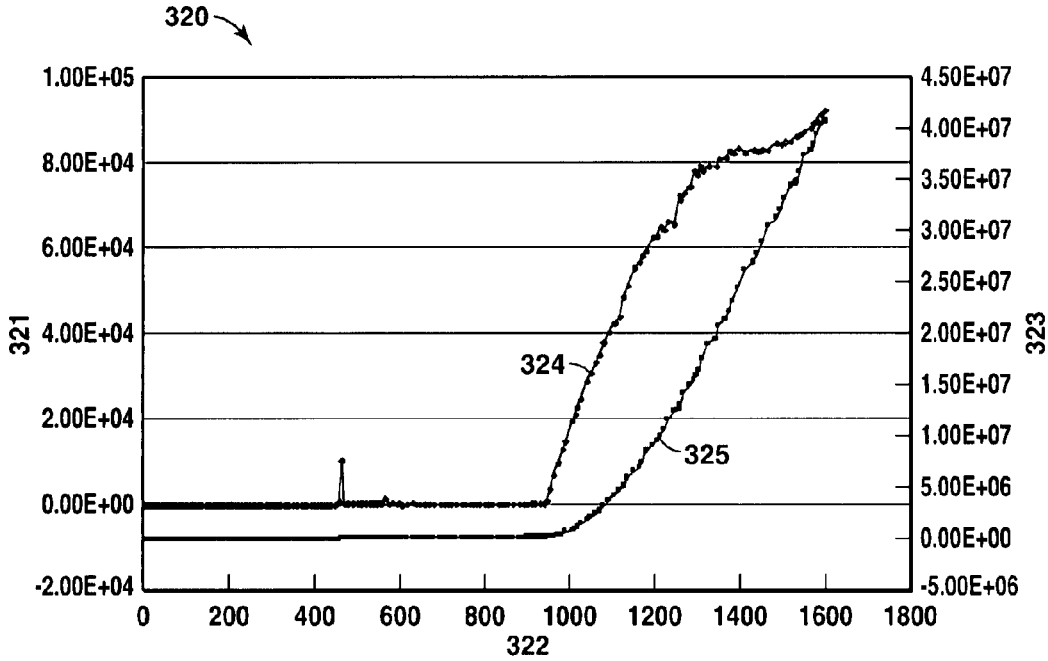
Figure 3D:
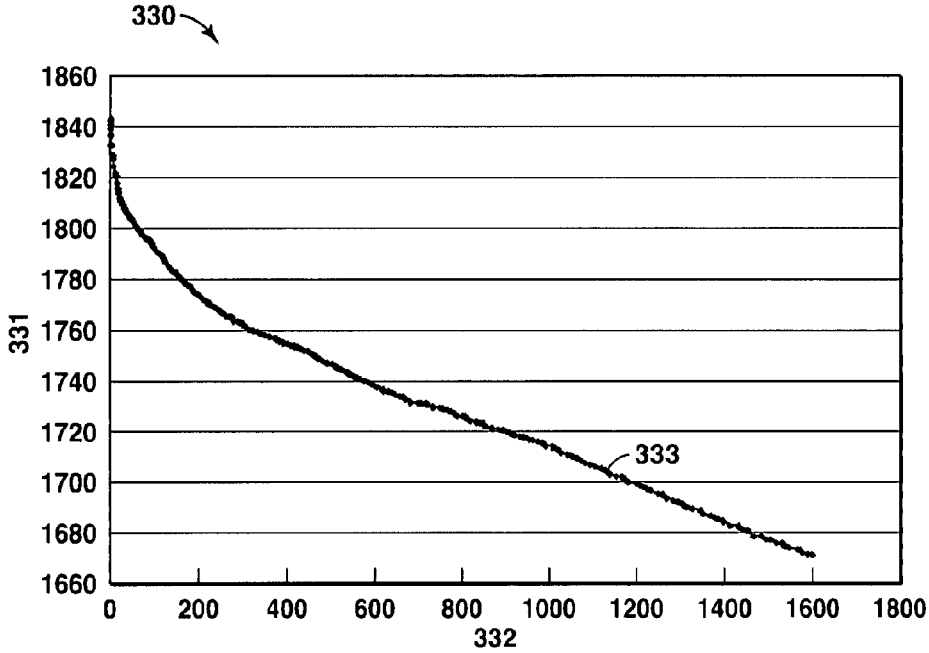

To achieve a VRR equal to 1 for each time step, additional water may have to be injected, as shown in the diagrams of FIGS. 3B-3D. Although a target VRR equal to 1 is specified, the injection rates are specified based on estimated rates at the beginning of the time step being solved. This is following the "traditional" voidage replacement algorithm described by equation (Eq5). In FIG. 3B, the diagram 310 of results of final calculations at the end of the time step for typical voidage replacement in reservoir volumetric units are shown. The results include an injection gas rate response 314, an injection water rate response 315, a production total rate 316, a VRR response 317 and a cumulative VRR response 318. For these responses 314-316, the values along a rate axis 311 in barrels per day (bbl/day) are plotted against a time axis 312 in days, while values on the VRR axis 313 are plotted against the time axis for the responses 317-318. Although the algorithm is intended to maintain a VRR equal to one, as shown in diagram 310, some error due to time step linearlization develops and the injection rates are lower than the desired quantity.

In FIG. 3C, the diagram 320 of the net gas rate and net cumulative gas for the current example are shown. For the net gas rate response 324, values for a net gas rate axis 321 in Standard Cubic Feet per day (SCF/day) are plotted against a time axis 322 in days, while values for a net gas cumulative axis 323 are plotted against the time axis 322 for a net gas cumulative response 325.

For the well management strategy, all the gas that was produced, but as shown in diagram 320, the predicted wells rates of responses 324-325 at the beginning of the time step underestimate the gas production rate, which indicates that the injection rates for the responses 314 and 315 of FIG. 3B were too low. By the end of the simulation at a time of about 1600 days, 40,000,000 SCF of gas have been produced, but this gas was not injected as was specified in example.

In FIG. 3D, the diagram 330 illustrates the average pressure along a pressure axis 331 in pounds per square inch atmospheric (psia) against the time axis 332 in days. As shown in diagram 330, the pressure was not maintained even though the VRR was close to 1. As shown in FIG. 3B, the average pressure has dropped almost 200 psi during the simulation. This drop in pressure can be attributed to not maintaining a VRR of one and using different reference conditions for volumetric calculations for the producers and injectors.

Figure 3E:
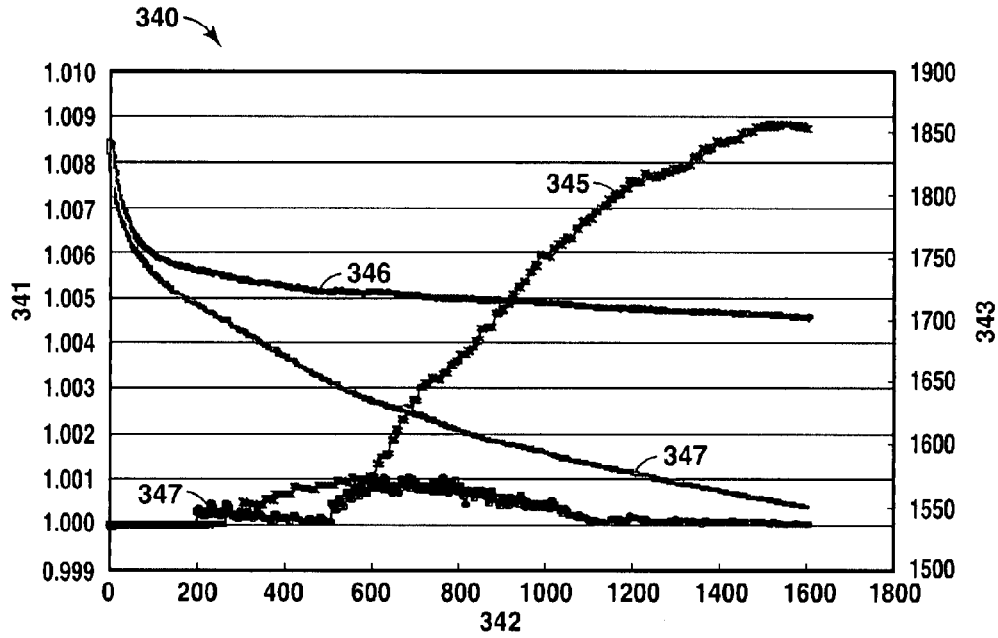

FIG. 3E illustrates a diagram 340 of the enhancements in the voidage replacement algorithms provided by the MBGs. As noted above in FIG. 3A, the gas and water produced is re-injected. However, in this example, gas is used to make up the difference in voidage. For the voidage replacement calculations of the MBGs, the region average pressure is used as the reference pressure and the relaxation time is 30 days. As shown in the diagram 340, values of a MBG VRR response 344 and a traditional VRR response 345 along a VRR axis 341 are plotted against a time axis 342 in days, while values of a MBG average pressure response 346 and a traditional average pressure response 347 along a pressure axis 343 in psia are plotted against the time axis 341. With regard to the VRR, the values of the MBG VRR response 344 has a much smaller deviation from 1 (e.g. the target VRR) than the traditional VRR response 345. Also, as indicated by the values of the MBG VRR response 344, the well management algorithm of the MBG redirects itself during the simulation to correct the time linearization error. With regard to the pressure, in an ideal reservoir region, setting a VRR equal to one should maintain the pressure in the reservoir region. By using the traditional voidage replacement algorithms, the values of the traditional average pressure response 347 decrease by almost 300 psi in 1600 days. However, while values of the MBG average pressure response 346 are decreasing, the well management algorithm of the MBGs reduces the error by about half the amount. By using the reservoir average pressure as the reference pressure for volumetric calculations and correcting for time step linearization errors, MBGs are able to maintain the reservoir pressure in an enhanced manner for the reservoir simulation. Further enhancements are discussed in the pressure maintenance algorithm below.

Pressure Maintenance Algorithms

In addition to the voidage replacement algorithms, another well management algorithm may include pressure maintenance algorithms. As described above, the average pressure in the reservoir is a very complex function of reservoir flow characteristics, fluid phase behavior, production rates and injection rates. As such, pressure maintenance is more complicated that just maintaining a VRR of about one. Further, a time delay is experienced by the pressure before changes in production or injection rates begin to affect the average reservoir pressure. Accordingly, for the pressure maintenance strategy, a reservoir engineer may specify a target average pressure for the geobody. The instantaneous VRR at each timestep to maintain that target pressure is then calculated using a Proportional-Integral-Derivative (PID) controller. The concept of a PID controller comes from process control theory. See, e.g., Segorg, Dale E., et al., *Process Dynamics and Control*, Wiley, N.Y., 1989, p. 195. Thus, process control theory may be used to control well management in a reservoir simulator.

In this implementation, a target VRR $VRR_{target}$ is dynamically calculated using the following equation (Eq6):

$$VRR_{target}=1.0+K_c*(E_p+1.0/\tau_l*\int E_p dt+\tau_d/\Delta t*(E_p-E_{p,old})) \quad \text{(Eq5)}$$

where $K_c$, $\tau_l$, $\tau_d$ are constants used to tune the PID controller. $E_p$ is the error in the target pressure minus the average pressure ($P_{target}-P_{average}$) and $\int E_p dt$ is the integration of pressure errors over time. $\int E_p dt$ for the current time step is calculated at the end of the previous time step by the equation (Eq7):

$$\int E_p dt+=(P_{target}-P_{average,\ beginning\ of\ TS\ value})*\Delta t \quad \text{(Eq6)}$$

where $P_{average,\ beginning\ of\ TS\ value}$ is the average pressure at the beginning of the time step.

To avoid "saturation" of the integral term $\int E_p dt$, if the calculated $VRR_{target}$ is greater than a user specified $VRR_{max}$, the value of $\int E_p dt$ is not updated. Typical values of $K_c$, $\tau_l$, $\tau_d$ are 1.0, 100, 0.0 respectively, but may vary by reservoir and the engineer's judgment.

Figure 4:
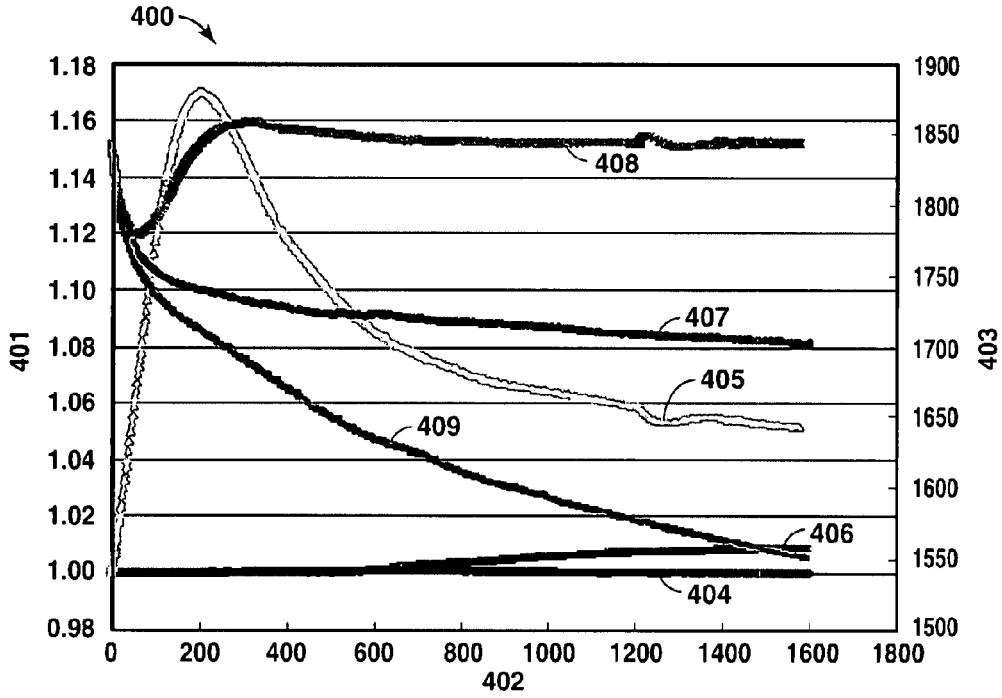
FIG. 4 is an exemplary diagram of responses for pressure maintenance algorithms for MBGs in accordance with some aspects of the present techniques.

An example of the use of the pressure maintenance is illustrated in FIG. 4. FIG. 4 describes a comparison of responses when the pressure maintenance algorithm is used instead of the traditional voidage replacement algorithm or the enhanced MBG algorithm. As shown in the diagram 400, values of a MBG VRR response 404, MBG pressure maintenance response 405, and a traditional VRR response 406 along a VRR axis 401 are plotted against a time axis 402 in days, while values of a MBG average pressure response 407, MBG pressure maintain response 408 and a traditional average pressure response 409 along a pressure axis 403 in psia (pressure per square inch absolute, which is also referenced as "psi" herein) are plotted against the time axis 401. In this example, the target pressure is set to an initial pressure of 1843 psi. A PID controller automatically adjusts the target VRR over time to compensate for initial errors in pressure and then to maintain the pressure at 1843 psi, as shown in MBG pressure maintain response 408. The MBG pressure maintenance algorithm can compensate for errors caused by complex fluid phase and flow behavior as well as "upsets" to the system caused by opening or closing of wells or changes in well rates. The MBG pressure maintenance response 405 is one indication of the non-ideal nature of the reservoir simulation. The MBG pressure maintenance algorithm correctly deviated the VRR away from one so as to return the average reservoir pressure to the target pressure.

Injection Allocation Algorithm

Figure 5:
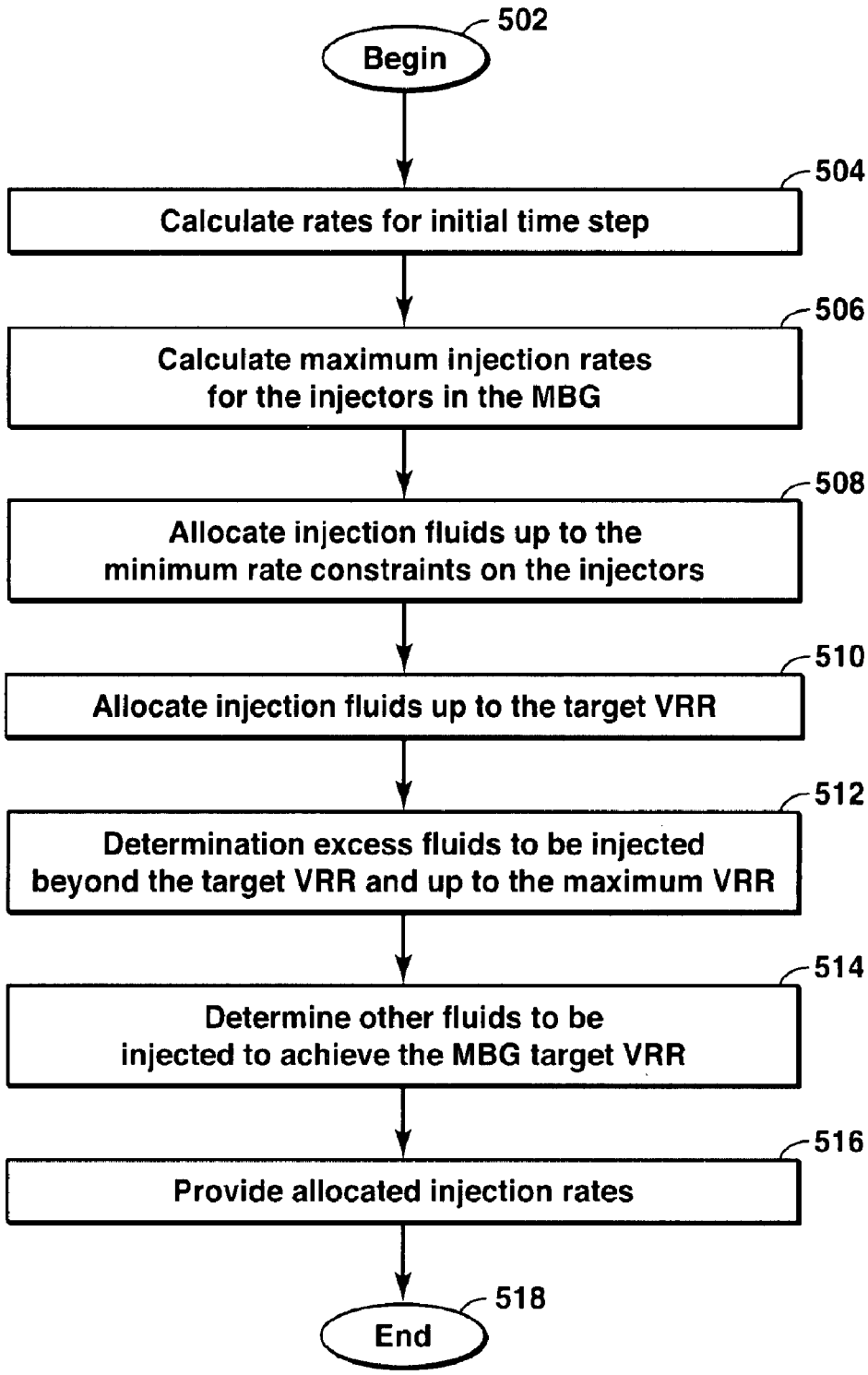
FIG. 5 is an exemplary flow chart of the formulation of injection allocation algorithms for MBGs in accordance with certain aspects of the present techniques.

Further, additional enhancements may be provided in injection allocation algorithms. For example, the reservoir engineer may specify constraints for the reservoir and the collection of wells represented by the MBG. The constraints may include maximum injection rate for injectors, maximum injection rate for the MBG, maximum delta pressure (e.g. difference in pressure between the reservoir and the well node), maximum well pressure, minimum injection rates (for well and MBG), minimum VRR, maximum VRR, and the like. To allocate fluids to the injectors, a process or injection allocation algorithm may be utilized, as discussed below in FIG. 5. Please note that this injection allocation algorithm is for exemplary purposes and assumes that production rates have already been set.

The flow chart begins at block 502. At block 504, production rates for initial time step are calculated. Production rates are often set by specifying the rate of one of the phases on each well (e.g. typically the liquid hydrocarbon phase). The rates of the other phases are estimated based on the reservoir conditions at the beginning of the time step, which are likely be different at the end of the time step. These estimated rates relate to the amount of gas and water available during the time step for injection. In particular, the estimates of reservoir and surface volume production rates are calculated at the beginning of time step, which may include user-specified external sources and subtracting user-specified external sinks. Then, the maximum injection rates for the injectors, which may be in the MBG, are calculated, as shown in block 506. The calculation of the maximum injection rates may include calculating rates when the well pressure is set to the minimum of the maximum well pressure and the minimum of the connected reservoir block pressure and the maximum delta pressure, comparing pressure-limited rates (e.g. the above calculated rates) with user specified maximum injection rates, and selecting the lower rate.

Once the maximum injection rates are calculated, the injection fluids are allocated in blocks 508-514. It should be noted that blocks 508-512 are subject to the amount of injection fluid available, which may be based on the calculation in block 504. In block 508, the injection fluids are allocated up to the minimum rate constraints on the injectors. The allocation of injection fluids may include allocating injection fluids to inject up to the MBG minimum VRR target (MinVRR target). The allocation of injection fluids may include three factors. First, the reservoir volume requested to meet the MBG constraint of minimum VRR may be calculated by the following equations (Eq8) and (Eq9).

$$VRR_{requested}=MAX(MBG\ VRR_{min}, (\Sigma\ \text{Min Injector Res rates})/\text{Voidage Rate}) \quad \text{(Eq8)}$$

$$Vol_{inj,res}=VRR_{requested}*Vol_{prod,res,estimated\ for\ timestep} \quad \text{(Eq9)}$$

wherein $VRR_{requested}$ is voidage replacement ratio to be allocated in block 508, MBG $VRR_{min}$ is the minimum voidage replacement ratio requested by the user, Min Injector Res rates are the minimum injection rates specified by the user at reservoir conditions, and Voidage Rate is the total reservoir volume production rate. The terms $Vol_{inj,res}$ and $Vol_{prod,res,estimated\ for\ timestep}$ are the same terms discussed above in equation (Eq4). Second, the maximum injection rates in surface units may be calculated by the equation (Eq10).

$$MIN(\text{Convert_to Surface_Rate}(Vol_{inj,res}), \text{Material Balance Constraints}) \quad \text{(Eq10)}$$

where Convert_to Surface_Rate represents a function that converts volumes at reservoir conditions to surface conditions and Material Balance Constraints are the minimum rate constraints specified by the user for the MBG. Third, fluids are allocated to the injectors. This allocation may include sorting injectors by user priority, injectivity, or other criteria and assigning injection fluids to injectors up to their minimum rates, MBG constraints, or until no more injection fluid is available from the results of equation (Eq10).

At block 510, the injection fluids are allocated up to the target VRR. The allocation of injection fluids in this block may include calculating the reservoir volume requested to meet the MBG target VRR and allocating the fluids to the injectors. The calculation of the reservoir volume requested may be based on the equations (Eq4) or (Eq6), which are discussed above. To allocate the fluids to the injectors, the injectors may be sorted by user priority, injectivity, or other criteria. Then, the injection fluids may be allocated until the requested reservoir volume is satisfied, or MBG constraints are satisfied, or until no more injection fluid are available.

At block 512, a determination about excess fluids to be injected beyond the target VRR and up to the maximum VRR may be made to dispose of excess fluids. The determination may be based on a selection by the reservoir engineer. In this block, which may optionally be performed, the injection of additional fluids, such as gas and water, may include calculating the reservoir volume requested to meet the MBG target of maximum VRR by using the following equation (Eq11):

$$Vol_{inj,res}=(VRR_{max}*Vol_{prod,res,cum}-Vol_{inj,res,cum})/\text{relaxation_time}+VRR_{max}*Vol_{prod,res,estimated\ for\ timestep} \quad \text{(Eq11)}$$

Then, the additional fluids may be allocated to injectors. The allocation of the additional fluids may include sorting injectors by user priority, injectivity, or other criteria and allocating injection fluids until the requested reservoir volume is satisfied, MBG constraints are satisfied, and/or until no more additional injection fluids are available.

At block 514, a determination is made whether the MBG has already allocated the amount requested to achieve the target VRR. If the target amount is not met, additional fluids may used to "make up the difference" to achieve the MBG target VRR. The other fluids may include fluids from an unspecified source to make-up the difference between the amount of injection fluid available and the amount of injection fluid needed to match the MBG target VRR value. The determination may include calculating the reservoir volume requested to satisfy the MBG constraint of a minimum VRR, which may be based on the equations (Eq4) and/or (Eq6) discussed above. Then, the other injection fluids may be allocated by sorting the injectors by user priority, injectivity, or other criteria and allocating other injection fluids until the requested reservoir volume is satisfied, MBG constraints are satisfied. Please note that no limit may be present on the available fluid for injection.

At block 516, the calculated injection rates are saved for the injector wells. This may involve storing the injection allocation algorithm parameters into memory, displaying the injection allocation algorithm parameters on a display unit or providing the injection allocation algorithm parameters to a simulation of a reservoir system. Regardless, the process ends at block 518.

Beneficially, this process enhances well management of the reservoir by providing an enhanced allocation process over traditional approaches and maintains the material balance. For instance, blocks 508-512 of the allocation process provide reservoir engineers with flexibility in setting minimum injection constraints, target injection constraints, and disposing of excess fluids, while honoring the material balance. In particular, block 514 gives the reservoir engineer the ability to calculate how much fluid is actually needed to achieve the requested voidage replacement or pressure maintenance. Accordingly, blocks 508-514 allow for enhanced flexibility over allocating in a single step in that every well gets their share of rate allocated to it for a given step before a moving on the next allocation.

Further, with a single step allocation process, one high capacity well may receive a higher priority than the other injectors. That is, the high capacity injector may receive all of the injection fluids, while other wells receive not injection fluid allocations. This may lead to unbalanced injection and poor sweep efficiency (poor oil recovery) in the reservoir. However, under the present allocation process, the injection fluids are allocated in a more distributed manner that balances the injection to provide enhanced oil recovery.

Parent-Child Relationships in MBGs

Figure 6A:
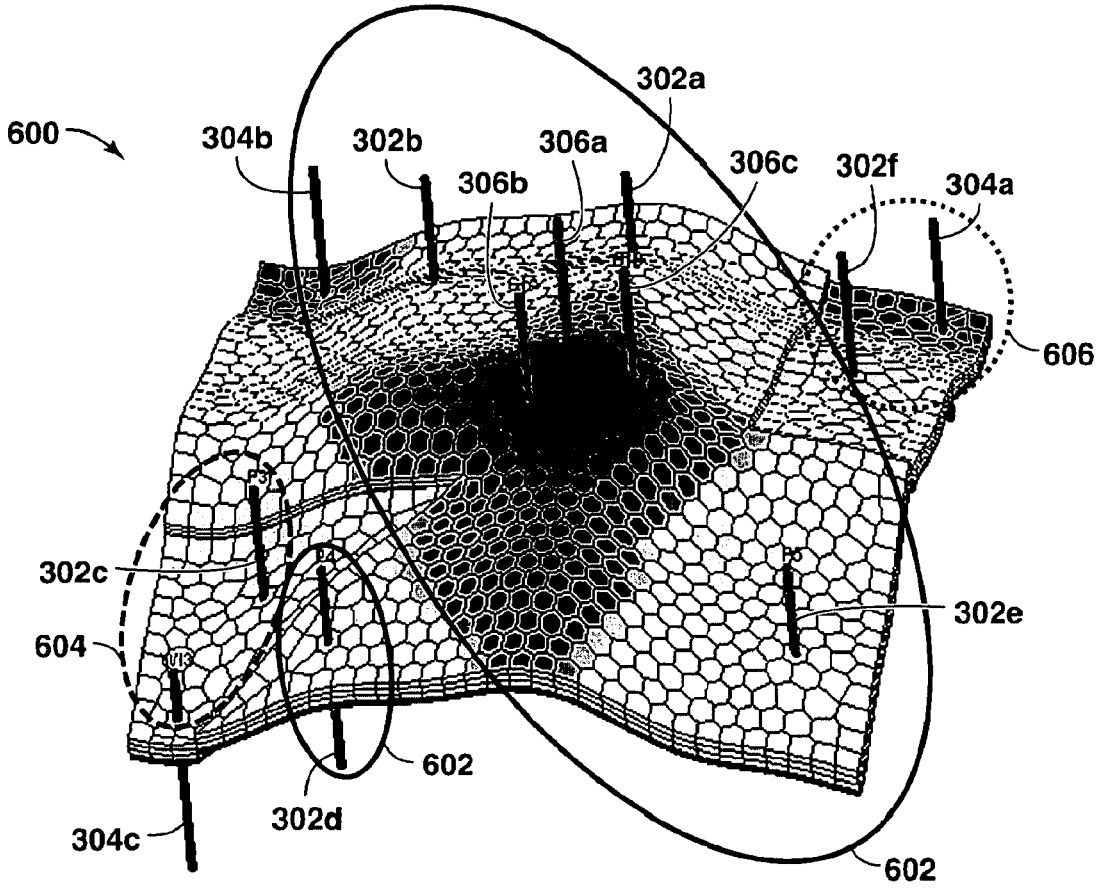
FIGS. 6A-6E are exemplary diagrams of a reservoir system model having MBGs in accordance with some embodiments of the present techniques.

To further enhance the use of MBGs, relationships may be established between collections of MBGs. As MBGs may represent different groupings of platforms, well patterns, fault blocks or groups of platforms, etc, different relationships may be established between MBGs to further enhance management of a reservoir system. For example, FIGS. 6A-6E are exemplary diagrams of a reservoir system model having MBGs in accordance with some embodiments of the present techniques. The FIGS. 6A and 6B may be best understood by concurrently viewing FIG. 3A. In FIG. 6A, an exemplary reservoir system model 600 has six producers 302*a*-302*f*, the water injectors 304*a*-304*c* and three gas injectors 306*a*-306*c*, which are discussed above. In this reservoir system model 600, the reservoir has been divided into a parent MBG and three child MBGs, which are a first MBG 602, a second MBG 604 and a third MBG 606. The relationships of the MBGs 602-606 are further described with reference to FIG. 6B.

Figure 6B:
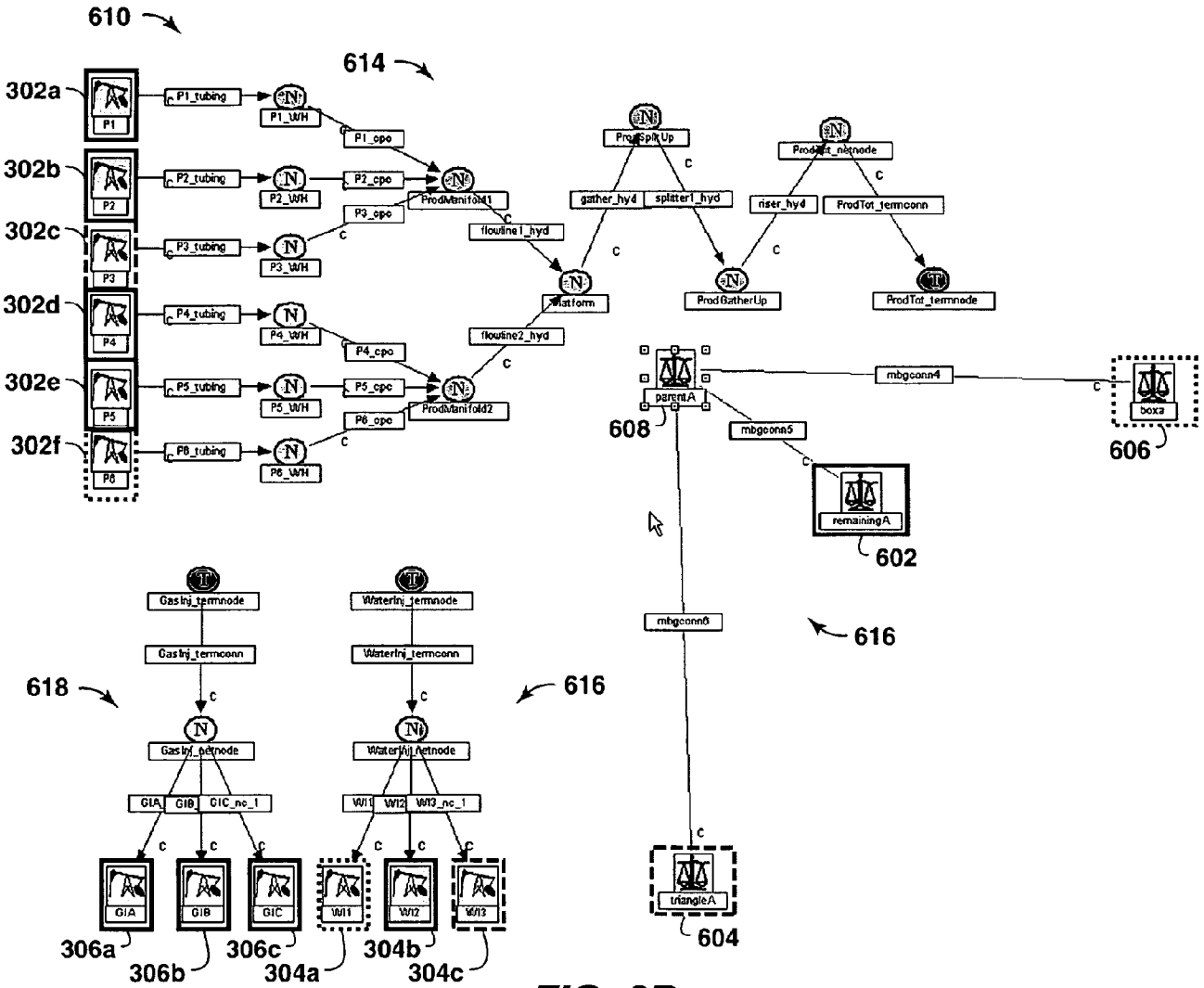
Figure 6C:
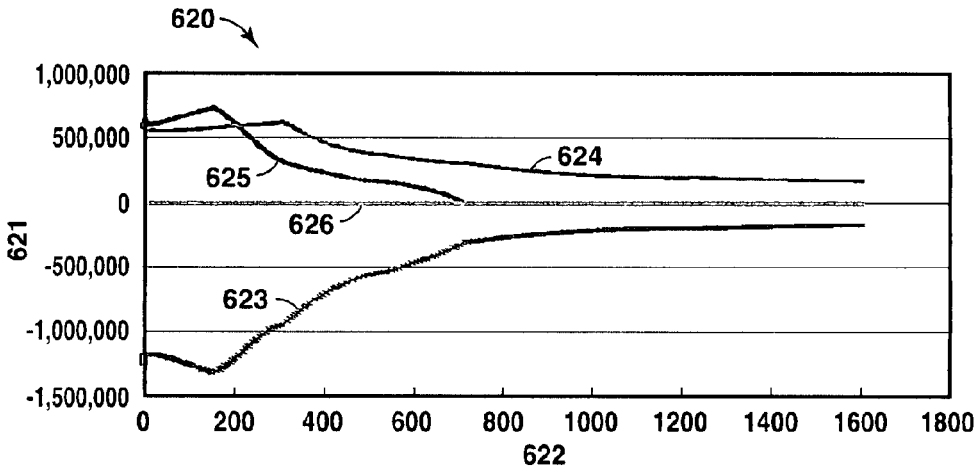

In FIG. 6B, a logic diagram 610 of the reservoir system model 600 of FIG. 6A is shown. In this diagram 610, different logical diagrams represent flow networks of the producers 302*a*-302*f*, injectors 304*a*-304*c* and 306*a*-306*c*, and represent the relationships of MBGs 602-608 for the exemplary reservoir system model 600. For instance, a MBG logic diagram 612 represents the relationships between the child MBGs 602-606 and a parent MBG 608. Also, a producer logic network 614 represents the relationships between producers 302*a*-302*f*, a water injector logic network 616 represents the relationships between water injectors 304*a*-304*c*, and a gas injector logic network 618 represents the relationships between water injectors 306*a*-306*c*. For each of these logic networks 614-618, the individual wells may be associated with a specific MBG, such as child MBGs 602-606. For instance, producers 302*a*, 302*b* and 302*e* along with injectors 304*b* and 306*a*-306*c* may be associated in the MBG 602. Similarly, the producers 302*c* along with injectors 304*c* may be associated in the MBG 604, while the producers 302*f* along with injectors 304*a* may be associated in the MBG 606. As shown in this diagram 610, the wells (e.g. producers and injectors) associated together in an MBG of the MBG logic diagram 612 do not have to be the same flow network for the reservoir system model 600.

To operate, the various algorithms of the MBG may be used to manage the reservoir simulation. For example, with regard to the injection allocation algorithm, a user may specify what action to take with the produced gas and water for each of the MBGs 602-608. In particular, the user may select to inject fluids at the child MBGs 602-606, export up to the parent MBG 608, import additional fluids from the parent MBG 608, and/or export/import to the parent MBG 608 (e.g. send fluids to parent MBG 608 and let the parent MBG 608 redistribute the fluids to the children). The parent MBG 608 can manage the distribution of fluids to the children MBGs 602-606 according to various prioritization strategies (e.g. user-specified, minimum VRR cumulative Min VRR cum, maximum oil production (Max Oil Production), minimum average pressure (Min average pressure), etc.). For injection allocation algorithms, calculations begin with the parent MBG 608, which follows the same flow described above in FIG. 5 for the injection allocation of a single MBG. However, for sorting of injectors or distribution to injectors, the parent MBG 608 sorts or distributes to the children MBGs 602-606, which then distribute to any children MBGs or wells.

As an example, the MBGs 602-608 may be defined as noted above in FIGS. 6A and 6B. In this model, the MBGs 602-608 may send all produced fluids (e.g. gas and water) to the parent MBG 608, which distributes the produced fluid back to the children MBGs 602-606. Then, if all produced fluids are to be re-injected, the pressure may be maintained in each region by injecting sufficient water. Because MBGs 604 and 606 do not have any gas injectors 306*a*-306*c*, these MBGs should have a net production of gas (e.g. positive). The MBG 602 should have a net injection of gas (e.g. negative), and the parent MBG 608 should have a net gas rate of zero. These results of the simulation of the reservoir system model are shown further in FIGS. 6C-6F In FIG. 6C, a diagram 620 of the net gas rates for the different MBGs 602-608 are shown. In this diagram, responses, such as first response 623 that represents MBG 602, a second response 624 that represents MBG 604, a third response 625 that represents MBG 606, and a fourth response 626 that represents the parent MBG 608, are shown for net gas rates along a net gas axis 621 in SCF against time along a time axis 622 in days. From these responses 623-626, the material balances (e.g. net gas rates) are enforced at the parent MBG level for each of the MBGs 602-608. Thus, all gas was allocated to the appropriate gas injectors as specified by the reservoir engineer.

Figure 6D:
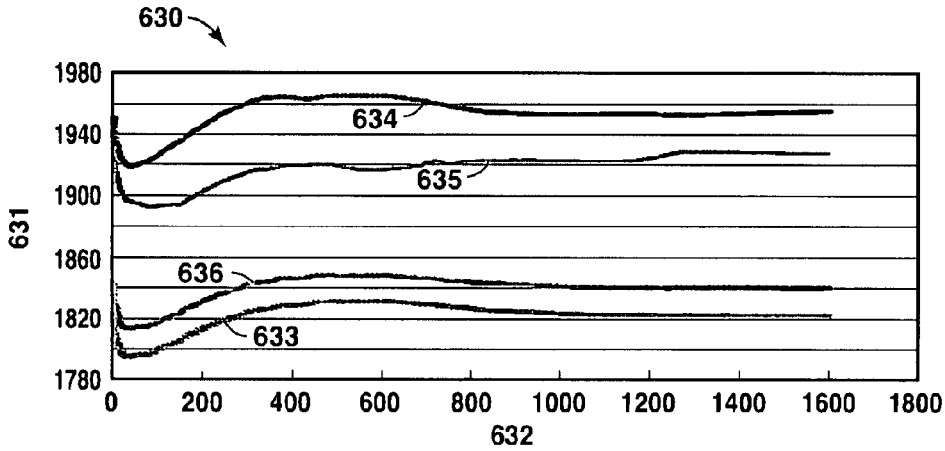

In FIG. 6D, a diagram 630 of the average pressure for the different MBGs 602-608 are shown. In this diagram 630, responses, such as first response 633 that represents MBG 602, a second response 634 that represents MBG 604, a third response 635 that represents MBG 606, and a fourth response 636 that represents the parent MBG 608, are shown for average pressures along a pressure axis 631 in psia against time along a time axis 632 in days. From these responses 633-636, the pressure maintenance algorithms of the MBGs maintained pressure in the three MBGs. The pressure for the MBG 606 did not quite return to its original pressure because the producer 302*f* was shut in and the injection from the region associated with that MBG 606 stopped.

Figure 6E:
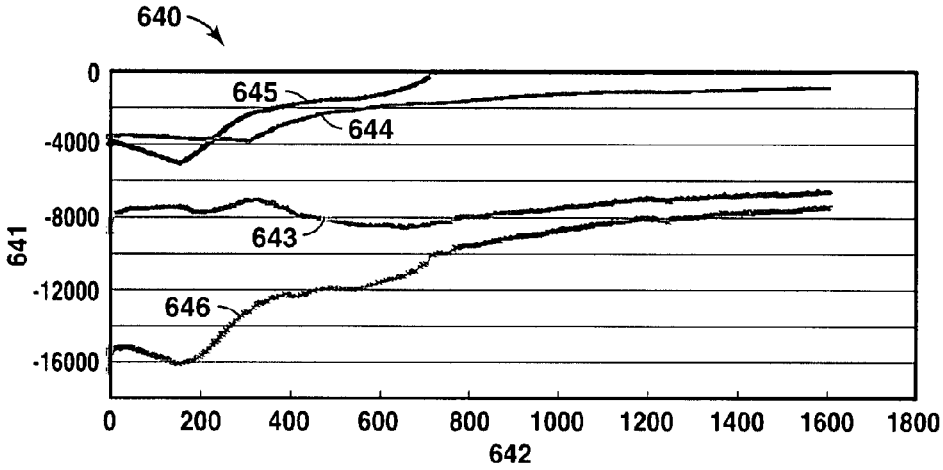

In FIG. 6E, a diagram 640 of the net water rate for the different MBGs 602-608 are shown. In this diagram 640, responses, such as first response 643 that represents MBG 602, a second response 644 that represents MBG 604, a third response 645 that represents MBG 606, and a fourth response 646 that represents the parent MBG 608, are shown for net water rate along a pressure axis 641 in STB against time along a time axis 642 in days. From these responses 643-646, the different water rates utilized to maintain pressure in the three regions associated with the MBGs 602-606 is shown. Accordingly, this example further demonstrates the value of a hierarchal structure of MBGs (e.g. collections of reservoir cells, producers, injectors) that enforces both material balance and volume balances for a well management strategy.

Monitoring and Controlling Flux

In addition, the MBGs may provide other benefits, such as monitoring and controlling flux. For instance, because MBGs contain a collection of reservoir cells, the current amount of hydrocarbons in the geobody may be computed at any time step. That is, the MBGs track the cumulative production and injection for the modeled reservoir system. Through the use of MBGs for material balance, the flow of hydrocarbons from one geobody to another can be computed by the equation (Eq12):

$$\text{Net_flux_out}=\text{Original_Amount}-\text{Current_Amount}-\text{Production}+\text{Injection} \quad \text{(Eq12)}$$

where Net_flux_out represents the fluid flowing across the geobody's boundaries Original_Amount is the amount of component (e.g. hydrocarbons) at the beginning of the simulation in moles, Current_Amount is the amount of component at the current simulation time. Production is the production of a component and Injection is the injection of the component. This equation (Eq12) can be used on a rate or cumulative basis along with other approaches for computing this quantity. Thus, the quantities in the equation (Eq12) may have units of moles, moles/time, etc. The Net_flux_out term may quantify various operations, such as conning of water, cusping of gas, movement of hydrocarbons into the water zone, water/gas encroachment, and the flow of hydrocarbons across a lease boundary. Examples of some of these aspects are discussed further below in FIGS. 7A and 7B.

Figure 7A:
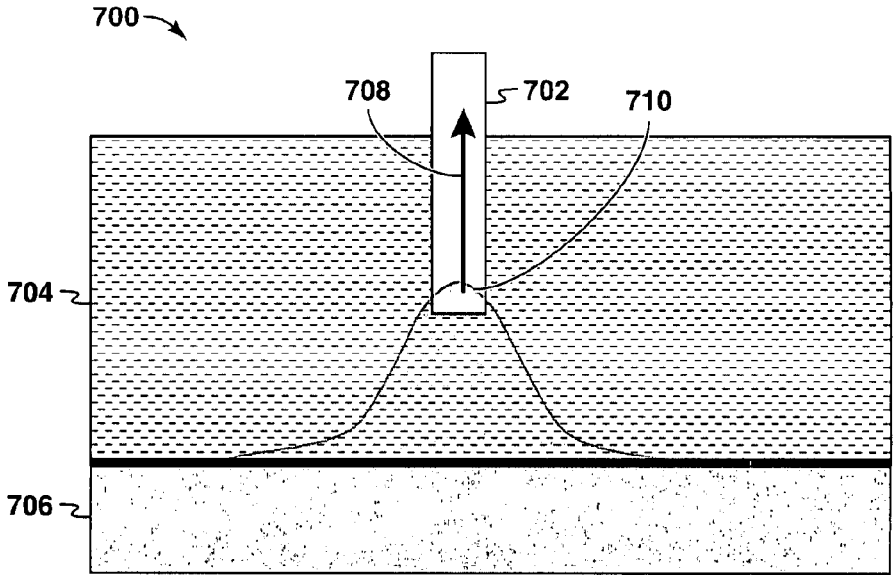
FIGS. 7A-7B are exemplary diagrams of the use of MBGs with water coning in a reservoir system model in accordance with some aspects of the present techniques.
Figure 7B:
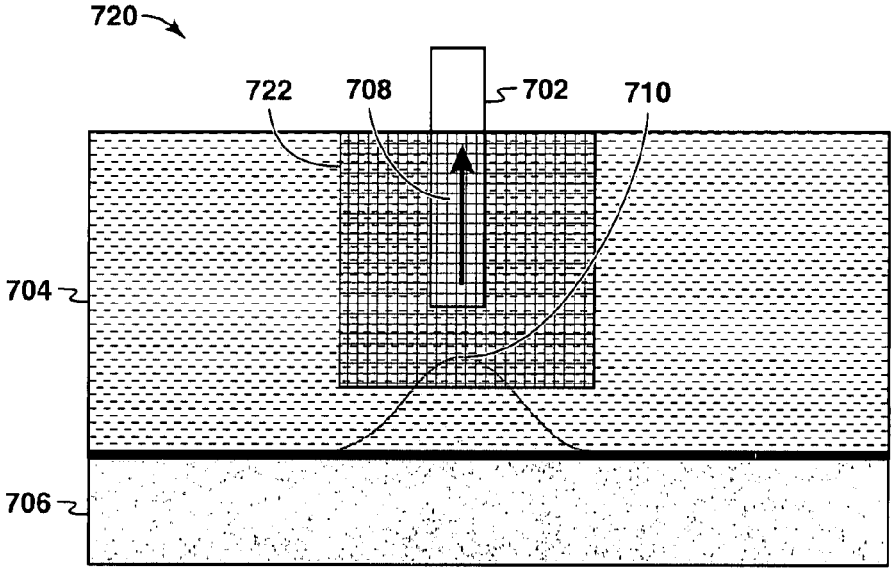

FIGS. 7A is an exemplary diagram of typical water coning in a reservoir system model 700, while FIG. 7B is an exemplary diagram of typical water coning in a reservoir system model 720 that utilizes MBGs. In the reservoir system models 700 and 720, a wellbore, such as a producer 702, provides a fluid flow path 708 for fluids within subsurface zones, such as a hydrocarbon zone 704 and a water zone 706. Water coning typically occurs in producers when the production rate is sufficiently high to draw water up from a water zone 706 below the bottom of the wellbore of the producer 702, which is the water cone 710. The pressure drawdown from the producer 702 overcomes gravity and water is drawn into the wellbore, as shown in FIG. 7A. If the rate is reduced the cone can "heal" (e.g. gravity pulls the water back down into the water zone 706). Accordingly, a rate may be determined and set for the producer 702, such that the lifting effect of the pressure draw down is in equilibrium with the effect of gravity so that the water cone does not reach the bottom of the wellbore. This equilibrium rate is very difficult to calculate a priori. Further, the equilibrium rate may change with time in the reservoir system and is a function of pressure, rate, fluid composition and rock type.

To manage the water coning, an MBG, such as MBG 722, may be defined and used to determine the equilibrium rate over time, as shown in FIG. 7B. The use of the MBG 722 may be similar to the use of the MBGs to maintain pressure in the reservoir systems discussed above. For example, process control theory can be used to set the rate on the producer 702 such that the net flux of water in the reservoir (e.g. zones 704 and 706) region modeled by the MBG is zero or a sufficiently small number, as shown in equation (Eq13) below.

$$Q_{producer}=Q_{target}+K_c*(E_{flux}+1.0/\tau_I*\int E_{flux}dt+\tau_d/\Delta t*(E_{flux}-E_{flux,old})) \quad \text{(Eq13)}$$

where the error terms ($E_{flux}$) is the difference between the calculated water flux into the MBG region and the user-specified allowed water flux, $Q_{producer}$ is the rate used to set the production rate, $Q_{target}$ is the desired production rate, and $K_c$, $\tau_I$ and $\tau_d$ are user-specified constants for the PID controller. The flux calculations and their associated controls can be based on the flow of a fluid in a particular direction or through a particular boundary of the reservoir geobody. Controls can be based on composition, such as the ratio between oil and water. Because the composition into the reservoir geobody eventually is the composition into the producer 702, using the MBG 722 around the producer 702 allows one to make adjustments to the well based on future results. In this manner, MBGs may be utilized to develop predictive well management.

Furthermore, MBGs described above may also be utilized with multiple wells or for other operations. For instance, the other operations may include gas cusping, pushing hydrocarbons into a water zone, controlling the movement of fluids into and out or a reservoir geobody. Each of these operations are similar to the water coning examples discussed above and may be managed with analogous controls. Also, MBG may also be used to set rates for a set of wells, which may include producers and/or injectors. For example, MBGs may used to set rates for an injector or a group of injectors where the geobody associated with the MBG surrounds the injectors. If the oil/water ratio of the fluid leaving the geobody falls below a certain value then the user may decide to reduce injection, shut in the injectors, and or allocate the fluids to a more favorable set of injectors Well Placement MBGs may also be utilized to determine placement of wells. That is, the MBGs may be used to determine when and where to drill wells and whether that wells should be producers and/or injectors. Because MBGs are associated with portions of the reservoir and include data of current and past well rates, MBGs may be used to develop algorithms to determine well placement. As an example, the reservoir geobodies may be searched for areas of by-passed oil. Then, well locations may be constrained by placing new wells at least a minimum distance from other wells or by using a particular well spacing or pattern to place new wells. This dynamic automated calculation may assist engineers in determining appropriate well locations for enhanced recovery. An example of the modeling system that may use MBGs is described in greater detail below in FIG. 8.

Exemplary Embodiment of Modeling System Using MBGs

Figure 8:
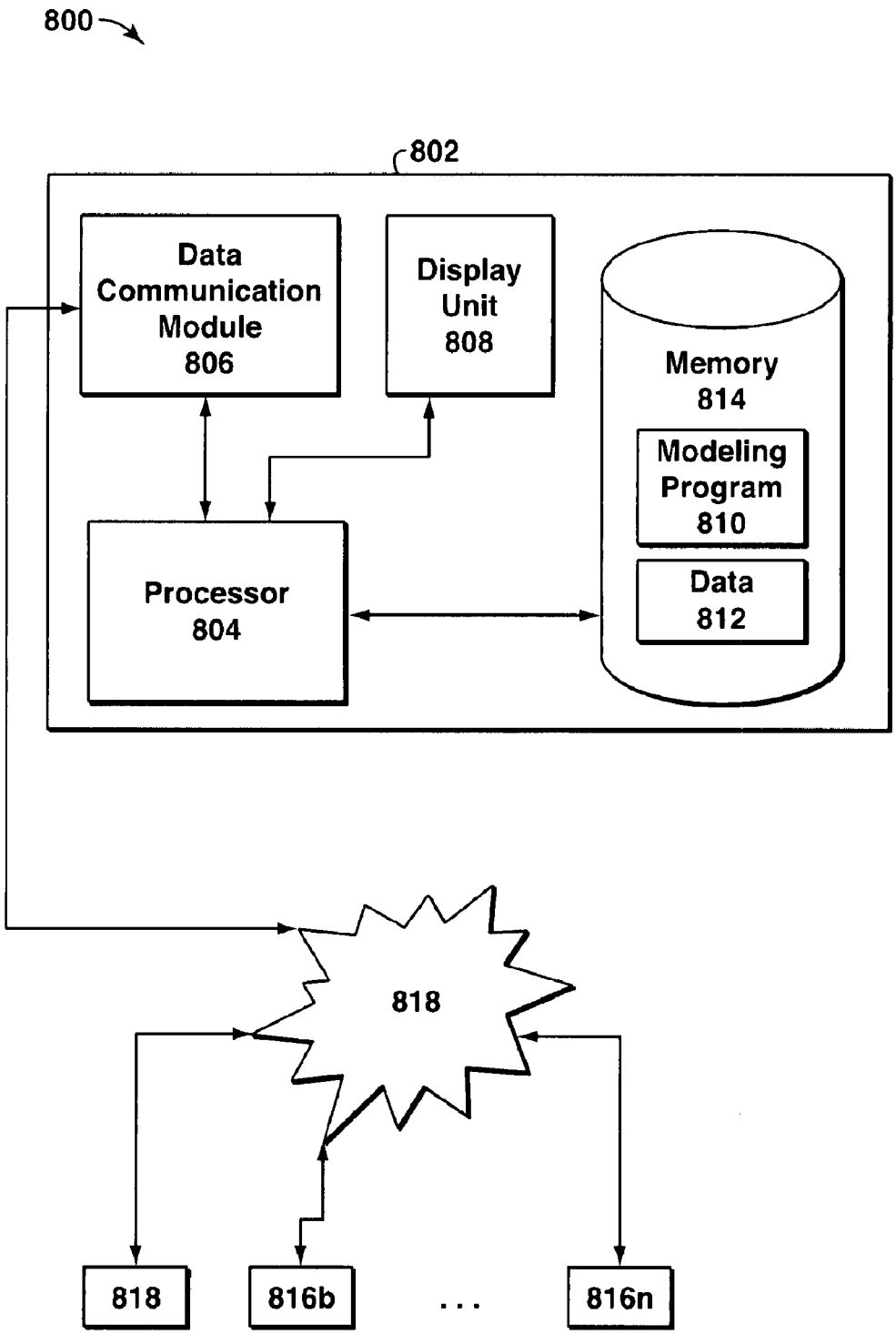
FIG. 8 is an exemplary embodiment of a modeling system in accordance with certain aspects of the present techniques.

As an exemplary embodiment, the methods and embodiments described above may be implemented in a modeling system or simulator, as shown in FIG. 8. FIG. 8 is an exemplary embodiment of a modeling system 200 having different elements and components that are utilized to model, calculate and display the results of the calculations (e.g. simulated results of calculated data in graphical or textual form) of the reservoir simulation. The modeling system 800 may include a computer system 802 that has a processor 804, data communication module 806, monitor or display unit 808 and one or more modeling programs 810 (e.g. routines, applications or set of computer readable instructions) and data 812 stored in memory 814. The computer system 802 may be a conventional system that also includes a keyboard, mouse and other user interfaces for interacting with a user. The modeling programs 810 may include the code configured to perform the methods described above, while the data 812 may include pressures, flow rates, and/or other information utilized in the methods described above. Of course, the memory 814 may be any conventional type of computer readable storage used for storing applications, which may include hard disk drives, floppy disks, CD-ROMs and other optical media, magnetic tape, and the like.

Because the computer system 802 may communicate with other devices, such as client devices 816*a*-816*n*, the data communication module 806 may be configured to interact with other devices over a network 818. For example, the client devices 816*a*-816*n* may include computer systems or other processor based devices that exchange data, such as the modeling program 810 and the data 812, with computer system 802. In particular, the client devices 816*a*-816*n* may be associated with drilling equipment at a well location or may be located within an office building and utilized to model BHA design configurations. As these devices may be located in different geographic locations, such as different offices, buildings, cities, or countries, a network 818 may be utilized provide the communication between different geographical locations. The network 818, which may include different network devices, such as routers, switches, bridges, for example, may include one or more local area networks, wide area networks, server area networks, metropolitan area networks, or combination of these different types of networks. The connectivity and use of the network 818 by the devices in the modeling system 800 is understood by those skilled in the art.

To utilize the modeling system, a user may interact with the modeling program 810 via graphical user interfaces (GUIs), which are described above. Via the screen views or through direct interaction, a user may launch the modeling program to perform the methods described above. As such, a user may interact with the modeling program to construct and execute the simulation of the reservoir model.

Parallel Processing of Well Management

As another benefit of using MBGs, MBGs may be processed on different systems, such as the computer system 802 and the client devices 816*a*-816*n*. As may be appreciated, one of the difficulties with well management is that it is difficult to develop computer implemented algorithms, which can be run or executed in parallel operation. With the hierarchical structure provided with MBGs, the reservoir simulation may be divided into multiple MBGs, which each MBG having its own well management strategy. As a result, the calculations for each MBG may be performed in parallel to reduce the time consumed to process the reservoir simulation in serial operation. In this manner, the reservoir engineer provides a natural decomposition for parallel well management of the reservoir simulation.

As with typical parallel execution of code, synchronization points may be required. As an example, in the parent-child pressure maintenance example give previously, a synchronization point may be required after the production rates are calculated to allow the parent MBG to sort and distribute the fluids to the children MBGs.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A method of modeling a reservoir system comprising:

constructing a reservoir model of a reservoir system, wherein the reservoir model comprises a reservoir and a plurality of wells;

constructing at least one material balance group, wherein the at least one material balance group comprises a portion of at least one of the plurality of wells, a portion of the reservoir, and at least one well management algorithm to track material balance within the at least one material balance group;

simulating fluid flow through the reservoir model based on the at least one material balance group by a simulator; and reporting results of the simulation;

wherein simulating fluid flow through the reservoir model includes determining boundary conditions for the reservoir model based at least partially on the at least one material balance group for a plurality of time steps, and solving fluid flow equations that represent the fluid flow through the reservoir model based on the boundary conditions for the plurality of time steps, wherein determining the boundary conditions includes calculating a cumulative voidage replacement ratio that is a cumulative volume of injected fluids at reservoir conditions divided by a cumulative volume of produced fluids at reservoir conditions, and calculating a volume injection rate ($Vol_{inj,res}$) in reservoir volumetric units for one of the plurality of time steps based on the equation $$Vol_{inj,res}=(VRR_{target}*Vol_{prod,res,cum}-Vol_{inj,res,cum})-/relaxation_time+VRR_{target}*Vol_{prod,res,estimated\ for\ timestep}$$

where $VRR_{target}$ is the target voidage replacement ratio, relaxation_time is the larger of a user specified parameter and a size of the one of the plurality of time steps, $Vol_{prod,res,cum}$ is a cumulative volume of produced fluids at reservoir conditions, $Vol_{inj,res,cum}$ is a cumulative volume of injected fluids at reservoir condition, and $Vol_{prod,res,estimated\ for\ timestep}$ is an estimated production rate of injectable fluids for the one of the plurality of time steps.

2. The method of claim 1 wherein the at least one material balance group couples reservoir behavior to a well management strategy represented by the at least one well management algorithm.

3. The method of claim 1 wherein reporting the results provides the results in an organization based on the at least one material balance group.

4. The method of claim 1 wherein the at least one well management algorithm responds to changes in the fluid flow rates during the simulation.

5. The method of claim 1 wherein the at least one well management algorithm is a voidage replacement algorithm that specifies a common reference pressure for the at least one material balance group.

6. The method of claim 1 wherein determining the boundary conditions comprises:

calculating a cumulative difference between specified injection rates at the beginning of one of the plurality of time steps and calculated production rates at the end of the one of the plurality of the time steps; and adding a portion of the cumulative difference to specified injection rates at the beginning of another of the plurality of time steps that follows the one of the plurality of time steps.

7. The method of claim 1 wherein determining the boundary conditions comprises solving a pressure maintenance algorithm to maintain a target average pressure that accounts for time delays associated with changes in production or injection.

8. The method of claim 1 wherein determining the boundary conditions comprises calculating a target voidage replacement ratio through the use of a proportional integral derivative controller.

9. The method of claim 8 further comprising calculating $\int E_p dt$ for the one of the plurality of time steps at the end of the previous time step by the equation:

$$\int E_p dt+=(P_{target}-P_{average,beginning\ of\ TS\ value})*\Delta t$$

where $P_{average,beginning\ of\ TS\ value}$ is the average pressure at the beginning of the time step.

10. The method of claim 1 wherein the at least one well management algorithm defines at least one constraint for the at least one material balance group, wherein the at least one constraint comprises one of maximum injection rate for injectors, maximum injection rate for the at least one material balance group, maximum delta pressure, maximum well pressure, minimum injection rates for one of the plurality of wells or material balance group, minimum voidage replacement ratio, maximum voidage replacement ratio, and any combination thereof.

11. The method of claim 1 further comprising allocating flow rates to the plurality of wells within the reservoir model based at least partially on the at least one material balance group.

12. The method of claim 11 wherein the allocated flow rates are further based on well data, well constraints and reservoir data.

13. The method of claim 11 wherein allocating flow rates to the plurality of wells comprises allocating injection rates to at least one of the plurality of wells.

14. The method of claim 13 wherein the plurality of wells comprise at least one producer well and at least one injector well; and allocating injection rates to the at least one of the plurality of wells comprises:

calculating production rates for the at least one producer well;

calculating maximum injection rates for the at least one injector well;

allocating injection fluids to the at least one injector well up to minimum rate constraints;

allocating injection fluids to the at least one injector well up to the target voidage replacement ratio; and providing allocated injection rates to the simulator for at least one of the plurality of time steps.

15. The method of claim 14 wherein calculating production rates for the at least one producer well comprises calculating estimates of reservoir volume production rates and surface volume production rates at the beginning of one of the plurality of time steps, wherein the reservoir volume production rates and surface volume production rates add user-specified external sources and subtract user-specified external sinks.

16. The method of claim 14 wherein calculating the maximum injection rates for the at least one injector well comprises:

calculating injection rates when well pressure is set to a minimum of a maximum well pressure and a minimum of connected reservoir block pressure and maximum delta pressure;

comparing the calculated injection rates with user specified maximum injection rates; and selecting the lower of the calculated injection rates and the user specified maximum injection rates.

17. The method of claim 14 wherein allocating injection fluids to the at least one injector well up to minimum rate constraints comprises:

calculating reservoir volume requested to meet the at least one material balance group constraint of a minimum voidage replacement ratio;

calculating maximum injection rates in surface units; and allocating the injection fluids to the at least one injector.

18. The method of claim 17 wherein the allocation of injection fluids is based on one of sorting injectors by user priority, injectivity, or any combination thereof.

19. The method of claim 14 wherein allocating injection fluids to the at least one injector well up to the target voidage replacement ratio comprises:

calculating reservoir volume requested to meet the at least one material balance group constraint of a target voidage replacement ratio; and allocating the injection fluids to the at least one injector.

20. The method of claim 14 further comprising allocating excess injection fluids to the at least one injector well greater than the target voidage replacement ratio.

21. The method of claim 14 further comprising allocating excess injection fluids to the at least one injector well up to the target voidage replacement ratio.

22. The method of claim 1 wherein constructing the at least one material balance group comprises constructing a plurality of material balance groups, wherein each of the plurality of material balance groups comprises a portion of at least one of the plurality of wells, a portion of the reservoir, and at least one well management algorithm to provide material balance tracking within the each of plurality of material balance groups.

23. The method of claim 22 wherein one of the plurality of material balance groups further comprises at least one material balance group of the plurality of material balance groups.

24. The method of claim 22 wherein each of the plurality of material balance groups are associated in a hierarchical structure between the plurality of material balance groups.

25. A method of modeling a reservoir system comprising:

constructing a reservoir model of a reservoir system, wherein the reservoir model comprises a reservoir and at least one injector well and at least one producer well;

associating a portion of the reservoir with a material balance group;

associating a portion of one or more well with the material balance group;

specifying at least one well management algorithm for the material balance group;

using the material balance group in the simulation of the reservoir model; and reporting results of the simulation, wherein simulating fluid flow through the reservoir model includes determining boundary conditions for the reservoir model based at least partially on the material balance group for a plurality of time steps, and solving fluid flow equations that represent the fluid flow through the reservoir model based on the boundary conditions for the plurality of time steps, wherein determining the boundary conditions includes calculating a cumulative voidage replacement ratio that is a cumulative volume of injected fluids at reservoir conditions divided by a cumulative volume of produced fluids at reservoir conditions, and calculating a volume injection rate ($Vol_{inj,res}$) in reservoir volumetric units for one of the plurality of time steps based on the equation $$Vol_{inj,res}=(VRR_{target}*Vol_{prod,res,cum}-Vol_{inj,res,cum})-/relaxation_time+VRR_{target}*Vol_{prod,res,estimated\ for\ timestep}$$

where $VRR_{target}$ is the target voidage replacement ratio, relaxation_time is the larger of a user specified parameter and a size of the one of the plurality of time steps, $Vol_{prod,res,cum}$ is a cumulative volume of produced fluids at reservoir conditions, $Vol_{inj,res,cum}$ is a cumulative volume of injected fluids at reservoir condition, and $Vol_{prod,res,estimated\ for\ timestep}$ is an estimated production rate of injectable fluids for the one of the plurality of time steps.

26. The method of claim 25 wherein the material balance group couples reservoir behavior to a well management strategy represented by the at least one well management algorithm.

27. The method of claim 25 wherein reporting the results provides the results in an organization based on the material balance group.

28. The method of claim 25 wherein the at least one well management algorithm is a voidage replacement algorithm that specifies a common reference pressure for the at least one material balance group.

29. The method of claim 25 wherein determining the boundary conditions comprises:

calculating a cumulative difference between specified injection rates at the beginning of one of the plurality of time steps and calculated production rates at the end of the one of the plurality of the time steps; and adding a portion of the cumulative difference to specified injection rates at the beginning of another of the plurality of time steps that follows the one of the plurality of time steps.

30. The method of claim 25 wherein determining the boundary conditions comprises solving a pressure maintenance algorithm to maintain a target average pressure that accounts for time delays associated with changes in production or injection rates.

31. The method of claim 25 wherein determining the boundary conditions comprises calculating a target voidage replacement ratio through the use of a proportional integral derivative controller.

32. The method of claim 31 further comprising calculating $\int E_p dt$ for the one of the plurality of time steps at the end of the previous time step by the equation:

$$\int E_p dt+=(P_{target}-P_{average,beginning\ of\ TS\ value})*\Delta t$$

where $P_{average,beginning\ of\ TS\ value}$ is the average pressure at the beginning of the time step.

33. The method of claim 25 wherein the at least one well management algorithm defines at least one constraint for the at least one material balance group.

34. The method of claim 25 wherein the at least one constraint comprises one of maximum injection rate for injectors, maximum injection rate for the at least one material balance group, maximum delta pressure, maximum well pressure, minimum injection rates for one of the plurality of wells or material balance group, minimum voidage replacement ratio, maximum voidage replacement ratio, and any combination thereof.

35. A computer-readable storage medium containing executable instructions which, when executed by a processor, perform operations for simulating fluid flow in a reservoir model comprising:

constructing a reservoir model of a reservoir system, wherein the reservoir model comprises a reservoir and a plurality of wells;

constructing at least one material balance group, wherein the at least one material balance group comprises a portion of at least one of the plurality of wells, a portion of the reservoir, and at least one well management algorithm to provide material balance tracking within the at least one material balance group;

simulating fluid flow through the reservoir model based on the at least one material balance group by a simulator; and reporting results of the simulation, wherein simulating fluid flow through the reservoir model includes determining boundary conditions for the reservoir model based at least partially on the material balance group for a plurality of time steps, and solving fluid flow equations that represent the fluid flow through the reservoir model based on the boundary conditions for the plurality of time steps, wherein determining the boundary conditions includes calculating a cumulative voidage replacement ratio that is a cumulative volume of injected fluids at reservoir conditions divided by a cumulative volume of produced fluids at reservoir conditions, and calculating a volume injection rate ($Vol_{inj,res}$) in reservoir volumetric units for one of the plurality of time steps based on the equation $$Vol_{inj,res}=(VRR_{target}*Vol_{prod,res,cum}-Vol_{inj,res,cum})-/relaxation_time+VRR_{target}*Vol_{prod,res,estimated\ for\ timestep}$$

where $VRR_{target}$ is the target voidage replacement ratio, relaxation—time is the larger of a user specified parameter and a size of the one of the plurality of time steps, $Vol_{prod,res,cum}$ is a cumulative volume of produced fluids at reservoir conditions, $Vol_{inj,res,cum}$ is a cumulative volume of injected fluids at reservoir condition, and $Vol_{prod,res,estimated\ for\ timestep}$ is an estimated production rate of injectable fluids for the one of the plurality of time steps.

36. The computer-readable storage medium of claim 35 wherein the at least one material balance group couples reservoir behavior to a well management strategy represented by the at least one well management algorithm.

37. The computer-readable storage medium of claim 35 wherein the at least one well management algorithm is a voidage replacement algorithm that specifies a common reference pressure for the at least one material balance group.

38. The computer-readable storage medium of claim 35 wherein determining the boundary conditions comprises:

calculating a cumulative difference between specified injection rates at the beginning of one of the plurality of time steps and calculated production rates at the end of the one of the plurality of the time steps; and adding a portion of the cumulative difference to specified injection rates at the beginning of another of the plurality of time steps that follows the one of the plurality of time steps.

39. The computer-readable storage medium of claim 35 wherein determining the boundary conditions comprises calculating a target voidage replacement ratio through the use of a proportional integral controller.

40. The computer-readable storage medium of claim 35 further comprising allocating flow rates to the plurality of wells within the reservoir model based at least partially on the at least one material balance group.

41. The computer-readable storage medium of claim 40 wherein allocating flow rates to the plurality of wells comprises allocating injection rates to at least one of the plurality of wells.

42. The computer-readable storage medium of claim 41 wherein the plurality of wells comprise at least one producer well and at least one injector well; and allocating injection rates to the at least one of the plurality of wells comprises calculating production rates for the at least one producer well;

calculating maximum injection rates for the at least one injector well;

allocating injection fluids to the at least one injector well up to minimum rate constraints;

allocating injection fluids to the at least one injector well up to the target voidage replacement ratio; and providing allocated injection rates to the simulator for at least one of the plurality of time steps.

43. The computer-readable storage medium of claim 35 wherein constructing the at least one material balance group comprises constructing a plurality of material balance groups, wherein each of the plurality of material balance groups comprises a portion of at least one of the plurality of wells, a portion of the reservoir, and at least one well management algorithm to provide material balance tracking within the each of plurality of material balance groups.

* * * * *